US007074752B2

(12) United States Patent
Gordon

(10) Patent No.: US 7,074,752 B2
(45) Date of Patent: Jul. 11, 2006

(54) FABRIC CARE COMPOSITIONS

(75) Inventor: Neil James Gordon, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 807 days.

(21) Appl. No.: 10/082,384

(22) Filed: Feb. 25, 2002

(65) Prior Publication Data

US 2002/0137653 A1 Sep. 26, 2002

Related U.S. Application Data

(63) Continuation of application No. PCT/US00/25691, filed on Sep. 20, 2000.

(60) Provisional application No. 60/199,616, filed on Apr. 25, 2000, and provisional application No. 60/154,977, filed on Sep. 21, 1999.

(51) Int. Cl.
*C11D 3/34* (2006.01)

(52) U.S. Cl. ..... 510/492

(58) Field of Classification Search ..... 510/492, 510/276

See application file for complete search history.

(56) References Cited

U.S. PATENT DOCUMENTS

| | | | |
|---|---|---|---|
| 3,753,913 | A | 8/1973 | Jarowenko |
| 5,490,944 | A | 2/1996 | Suazon |
| 5,929,009 | A | 7/1999 | Gambogi |
| 6,110,886 | A | 8/2000 | Scepanski |

FOREIGN PATENT DOCUMENTS

| | | |
|---|---|---|
| DE | 2 154 318 | 5/1973 |
| GB | 427899 | 5/1935 |
| WO | WO 93/09215 | 5/1993 |
| WO | WO 97/42292 | 11/1997 |
| WO | WO 97/46658 | 12/1997 |
| WO | WO 99/15612 | 4/1999 |

OTHER PUBLICATIONS

Aldrich Chemical Co. Catalog, 1994–1995, Aldrich Chemical Co., Milwaukee, WI, Dec. 1994.*

* cited by examiner

*Primary Examiner*—John R. Hardee
(74) *Attorney, Agent, or Firm*—Armina E. Matthews; Richard S. Echler, Sr.; Kim W. Zerby

(57) ABSTRACT

The present invention relates to fabric care compositions having enhanced fabric color protection, said compositions comprising a bleach scavenging system comprising:

Figure 1:
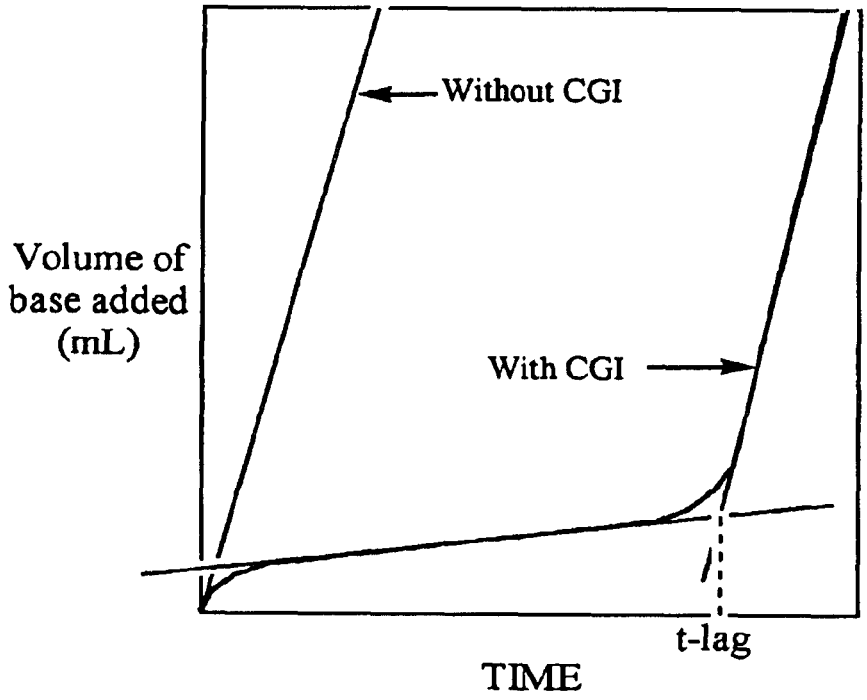

i) one or more organic sulfur compounds having the formula:

R—S—R or R—S—S—R wherein each R is independently hydrogen, $C_2$–$C_{20}$ linear or branched, substituted or unsubstituted alkyl; provided at least one R unit is not hydrogen;

ii) one or more inorganic sulfur compounds selected from the group consisting of the sodium, potassium, lithium, calcium, and magnesium salts of metabisulfite, thiosulfate, sulfite, bisulfite, and mixtures thereof; and iii) and mixtures thereof.

20 Claims, 1 Drawing Sheet

FABRIC CARE COMPOSITIONS

This is a continuation of International Application PCT/US 00/25691 filed Sep. 20, 2000; Provisional Application Ser. No. 60/154,977 filed Sep. 21,1999, and Provisional Application Ser. No. 60/199,616 filed Apr. 25, 2000.

FIELD OF THE INVENTION

The present invention relates to fabric care and fabric enhancement compositions which maintain fabric appearance. The compositions of the present invention comprise one or more inorganic or organic sulfur compounds which have the capacity to scavenge bleaching compounds.

BACKGROUND OF THE INVENTION

Mitigation of color loss or dye damage is a key element of fabric care. Historically, leaching of dyes from fabric produced an inexorable fading problem which has been largely overcome by the use of modem fabric substantive dyes, inter alia, "azo-dyes". One drawback of azo dyes relates to the interaction of these dye molecules with heavy metals found in water. Dissolved metals, copper, inter alia, interact with fabric dye molecules thereby shifting the fabric dye emission spectra and producing a diffuse rather than a sharp, narrow emission band hue. Although the dye molecule itself is still present on the fabric, the result of this heavy metal/dye interaction is an appearance of color loss or fabric fading.

Polyamine chelants, inter alia, polyethyleneimines, have been used as chelants to suppress the activity of unwanted heavy metals. However, one drawback to the use of polyamines is their capacity to also chelate metal atoms which are a part of the dye molecule itself, for example, phthalocyanine dyes. This chelation of dye-based metals also results in the attenuation of fabric color. One solution is to strictly limit the amount of polyamine chelant used in detergent formulation to an amount which is sufficient only to chelate and remove unwanted heavy metals in the laundry liquor.

But polyamines which serve as chelating agents are also effective scavengers of fugitive bleaches. Bleaches are ruinous to dyed fabric because they can chemically alter dye molecules thereby producing non-colored molecules. The polyamines scavenge bleaches by reacting with the bleaches to form N-oxides or N-chloro polyamines depending upon the type of fugitive bleach. The reaction of polyamines with bleaches produces a modified polyamine thereby reducing or otherwise nullifying the usefulness of the polyamine as a chelant. Therefore, the formulator is left with the problem of deciding the proper amount of chelant to use. Not every consumer will be faced with the same level of fugitive bleach, therefore, a formulation which anticipates heavy bleach scavenging will provide excess polyamine in a non-bleach context, an excess of polyamine which can react pejoratively with the fabric dye molecules. On the other hand, a composition comprising an insufficient amount of polyamine chelant will not have a sufficient amount present to insure chelation of unwanted heavy metals and thereby ameliorate any color loss due to heavy metal/fabric dye association.

There is a long felt need for a laundry detergent composition or fabric care additive composition which will effectively mitigate the fabric dye damage caused by fugitive bleaches while allowing the formulation of polyamine chelants in an amount necessary to remove unwanted heavy metal ions.

SUMMARY OF THE INVENTION

The present invention meets the aforementioned needs in that it has been surprisingly discovered that certain sulfur containing compounds are effective bleach scavenging agents. These compounds can be formulated into compositions which comprise other bleach sensitive adjuncts, inter alia, polyamines, thereby protecting the integrity of fabric color as well as the activity of adjunct ingredients.

A first aspect of the present invention relates to fabric care compositions comprising:

a) from about 0.01%, preferably from about 0.1%, more preferably from about 1%, most preferably from about 5% to about 50%, preferably to about 30%, more preferably to about 20% by weight, of a bleach scavenging system, said system comprising at least one compound from (i) or (ii):

i) one or more organic sulfur compounds having the formula:

R—S—R or R—S—S—R wherein each R is independently hydrogen, $C_2$–$C_{20}$ linear or branched, substituted or unsubstituted alkyl; provided at least one R unit is not hydrogen;

ii) one or more inorganic sulfur compounds selected from the group consisting of the sodium, potassium, lithium, calcium, and magnesium salts of metabisulfite, thiosulfate, sulfite, bisulfite, and mixtures thereof; and b) the balance carriers and adjunct ingredients.

A further aspect of the present invention relates to laundry detergent compositions which provide bleach scavenging benefits especially when used under conditions wherein bleach from a previous wash cycle is carried over into the wash or where an oxidative species is present which potentially has a pejorative effect on one or more of the composition ingredients as well as the fabric itself.

The present invention further relates to sunlight induced fabric dye fading. The systems of the present invention provide for reduction of fabric color damage due to sunlight.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The present invention relates to fabric care compositions and laundry detergent compositions which comprise a bleach scavenging system. The bleach scavenging system is comprised of one or more sulfur compounds which are readily oxidized by bleaching materials, inter alia, hypochlorite ion, peroxygen. When present in the compositions of the present invention the bleach scavenging system will comprise from about 0.01%, preferably from about 0.1%, more preferably from about 1%, most preferably from about 5% to about 50%, preferably to about 30%, more preferably to about 20% by weight, of said composition. The bleach scavenging systems of the present invention may suitably comprise only one sulfur containing compound or a combination of two or more compounds whether organic or inorganic molecules. Preferably the scavenging systems of the present invention comprise a single organic sulfur compound or a single inorganic sulfur compound.

For the purposes of the present invention, the salts of organic molecules can be pre-formed or can be formed in situ. However, the salt of a sulfur containing compound is equally suitable as an ingredient in the bleach scavenging systems of the present invention.

The sulfur compounds of the present invention can be any organic or inorganic sulfur comprising compound which is readily oxidized. The preferred organic sulfur compounds have the general formula:

R—S—R or R—S—S—R wherein each R is independently hydrogen, $C_2$–$C_{20}$ linear or branched, substituted or unsubstituted alkyl; provided at least one R unit is not hydrogen. Preferably R is a substituted $C_2$–$C_5$ linear or branched alkyl moiety. Preferred substituents include $C_1$–$C_3$ alkyl, for example, methyl, ethyl, n-propyl, iso-propyl; —$N(R^1)_2$, —$CON(R^1)_2$, —$CO_2R^1$, and mixtures thereof; wherein $R^1$ is hydrogen, $C_1$–$C_5$ linear or branched alkyl, and mixtures thereof. A preferred sulfur comprising compound useful as a bleach scavenger are the sulfur containing amino acids and their esters, non-limiting examples of which include cystamine, cysteine, cysteine dimethyl ester, cystine, cystine dimethyl ester, methionine, cystathionine. Also suitable are bis carboxylate thio compounds, inter alia, 3,3'-thiodipropionic acid.

Inorganic sulfur compounds are also suitable for use in the bleach scavenging compositions of the present invention. Non-limiting examples of preferred inorganic sulfur containing compounds include the sodium, potassium, lithium, magnesium, calcium, and mixtures thereof salts of sulfite, bisulfite, thiosulfate, and metabisulfite.

FORMULATIONS

Rinse-added, Pre-treatment, and Post-treatment Fabric Enhancement Compositions The ingredients which comprise the formulations of the present invention, including the bleach scavenging system, vary depending upon the type of fabric enhancement benefit the formulator wishes to provide. The following are non-limiting examples of compositions and their corresponding fabric appearance benefits.

In general, the compositions of the present invention comprise:

a) from about 0.01%, preferably from about 0.1%, more preferably from about 1%, most preferably from about 5% to about 50%, preferably to about 30%, more preferably to about 20% by weight, of a bleach scavenging system, said system comprising at least one compound from (i) or (ii):
   i) one or more organic sulfur compounds having the formula:

R—S—R or R—S—S—R wherein each R is independently hydrogen, $C_2$–$C_{20}$ linear or branched, substituted or unsubstituted alkyl; provided at least one R unit is not hydrogen;
   ii) one or more inorganic sulfur compounds selected from the group consisting of the sodium, potassium, lithium, calcium, and magnesium salts of metabisulfite, thiosulfate, sulfite, bisulfite, and mixtures thereof;

b) optionally from about 0.001% to about 90% by weight, of one or more dye fixing agents;

c) optionally from about 0.01% to about 50% by weight, of one or more cellulose reactive dye fixing agents;

d) optionally about 0.005% to about 1% by weight, of one or more crystal growth inhibitors;

e) optionally from about 0.01% to about 20% by weight, of a fabric abrasion reducing polymer;

f) optionally from about 1% to about 12% by weight, of one or more liquid carriers;

g) optionally from about 0.001% to about 1% by weight, of an enzyme;

h) optionally from about 0.01% to about 8% by weight, of a polyolefin emulsion or suspension;

i) optionally from about 0.01% to about 0.2% by weight, of a stabilizer;

j) optionally from about 1% to about 80% by weight, of a fabric softening active;

k) optionally less than about 15% by weight, of a principal solvent;

l) optionally from about 0.5% to about 10% by weight, of a cationic nitrogen compound; and m) the balance carrier and adjunct ingredients.

Polyamine Dye Chelation Compositions

The compositions of the present invention afford protection of fabric dyes from the effects of both peroxygen and chlorine bleaches. Typically, as a pre-treatment, post-treatment, or rinse-added composition, the bleach protecting agents are applied to fabric. These ingredients then protect the fabric from dye loss and/or dye damage due to the presence of bleaching agents in subsequent wash cycles. Due to the high substantivity of may of the presently disclosed ingredients, even when only treated once by the compositions of the present invention, protection is afforded for several wash cycles.

It has been surprisingly discovered that the combination of one or more low molecular weight polyamines of the present invention in combination with a hydrophobic dispersant, preferably a hydrophobic dispersant as disclosed in U.S. Pat. No. 5,565,145 Watson et al., issued Oct. 15, 1996, provide fabric color care protection. A preferred embodiment comprises:

a) from about 0.01%, preferably from about 0.1%, more preferably from about 1%, most preferably from about 5% to about 50%, preferably to about 30%, more preferably to about 20% by weight, of a bleach scavenging system, said system comprising:
   i) one or more organic sulfur compounds having the formula:

R—S—R or R—S—S—R wherein each R is independently hydrogen, $C_2$–$C_{20}$ linear or branched, substituted or unsubstituted alkyl; provided at least one R unit is not hydrogen;
   ii) optionally, one or more inorganic sulfur compounds selected from the group consisting of the sodium, potassium, lithium, calcium, and magnesium salts of metabisulfite, thiosulfate, sulfite, bisulfite, and mixtures thereof;

b) from about 0.1%, preferably from about 5%, more preferably form about 10% to about 80%, preferably to about 50%, more preferably to about 25% by weight, of a polyamine having the formula:

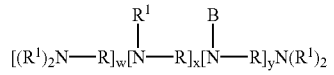

wherein B is a continuation of the polyamine backbone by branching; R is preferably ethylene; $R^1$ is preferably an ethyleneoxy unit having the formula:

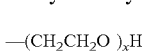

wherein x has the average value from 0.5 to about 10, preferably x is from 3 to about 7; the values of the indices w, x, and y are such that the molecular weight of the backbones prior to ethoxylation are preferably at least about 1200 daltons, more preferred backbone has a molecular weight of about 1800 daltons; and c) the balance carriers and adjunct ingredients.

Fabric Anti-Encrustation and Stiffness

The compositions of the present invention affords increased softness to fabric, especially cotton fabric which can suffer mechanical breakdown (loss of fabric structure integrity) due to the deposition of scale (calcium deposits) upon the fabric. The deposition of scale modifies the fabric surface and prevents cationic softeners from having their fullest affect at providing a porous "breathable" substrate surface. Typically, as a rinse-added composition, the scale mediating agents are applied to fabric together with the bleach scavenging component. These ingredients then protect the fabric from unwanted deposition of calcium, magnesium, etc. ions which preclude the efficient deposition onto the fabric surface of other fabric enhancement ingredients.

It has been surprisingly discovered that the combination of the bleach scavenging system of the present invention in combination with a chelant, preferably hydroxyethane-1,1-diphosphonate (HEDP), BAYHIBIT ex Baeyer, provides enhanced mediation of calcium and other scale comprising deposits. Preferably these ingredients are combined with one or more hydrophobic dispersants, preferably a hydrophobic dispersant as disclosed in U.S. Pat. No. 5,565,145 Watson et al., issued Oct. 15, 1996. A preferred embodiment comprises:

a) from about 0.01%, preferably from about 0.1%, more preferably from about 1%, most preferably from about 5% to about 50%, preferably to about 30%, more preferably to about 20% by weight, of a bleach scavenging system, said system comprising:

i) one or more organic sulfur compounds having the formula:

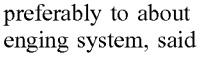

wherein each R is independently hydrogen, $C_2$–$C_{20}$ linear or branched, substituted or unsubstituted alkyl; provided at least one R unit is not hydrogen;

ii) one or more inorganic sulfur compounds selected from the group consisting of the sodium, potassium, lithium, calcium, and magnesium salts of metabisulfite, thiosulfate, sulfite, bisulfite, and mixtures thereof;

b) from about 0.1%, preferably from about 5%, more preferably form about 10% to about 80%, preferably to about 50%, more preferably to about 25% by weight, of a chelant, hydrotrope, or other alkaline earth cation mediating agent; and c) the balance carriers and adjunct ingredients.

Fabric Enhancement Compositions

The Pre-treatment, Post-treatment fabric enhancement compositions of the present invention comprise:

a) from about 0.01%, preferably from about 0.1%, more preferably from about 1%, most preferably from about 5% to about 50%, preferably to about 30%, more preferably to about 20% by weight, of a bleach scavenging system, said system comprising:

i) one or more organic sulfur compounds having the formula:

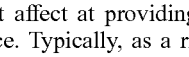

wherein each R is independently hydrogen, $C_2$–$C_{20}$ linear or branched, substituted or unsubstituted alkyl; provided at least one R unit is not hydrogen;

ii) one or more inorganic sulfur compounds selected from the group consisting of the sodium, potassium, lithium, calcium, and magnesium salts of metabisulfite, thiosulfate, sulfite, bisulfite, and mixtures thereof;

b) the balance carriers and other adjunct ingredients.

A preferred embodiment of the present invention comprises:

a) 15% cystamine dihydrochloride; and b) the balance carriers and adjunct ingredients.

A further preferred embodiment of the present invention comprises:

a) 10% magnesium metabisulfite; and b) the balance carriers and adjunct ingredients.

Sunlight Dye Protection Compositions

The compositions of the present invention provide protection against fabric dye fading due to the effects of sunlight on dye molecules. The compositions of the present invention can serve as free radical scavengers especially when the compositions of the present invention are delivered to the fabric surface as via an aqueous solution. The embodiments of the sun fading protection include laundry added composition which deposit the protective agent or spray on compositions which can be applied to fabrics which are dried in the open (line drying) or to fabrics which are continuously exposed to light, inter alia, awnings, umbrellas.

A preferred sun fade protection embodiment comprises:

a) from about 0.0001%, preferably from about 0.001%, more preferably from about 0.005% to about 20%, preferably to about 10%, more preferably to about 5% by weight, of a sunlight protection system, said system comprising:

i) one or more organic sulfur compounds having the formula:

wherein each R is independently hydrogen, $C_2$–$C_{20}$ linear or branched, substituted or unsubstituted alkyl; provided at least one R unit is not hydrogen;

ii) optionally, one or more inorganic sulfur compounds selected from the group consisting of the sodium, potassium, lithium, calcium, and magnesium salts of metabisulfite, thiosulfate, sulfite, bisulfite, and mixtures thereof; and b) the balance carriers and adjunct ingredients.

A preferred sun fade protector is thiodipropionic acid (TDPA) which has the advantages over other radical inhibitors in that TDPA does not yellow upon application to fabric and TDPA is water soluble which allows for direct formulation into an aqueous carrier.

An example of a preferred TDPA composition comprises:

a) from about 0.0001%, preferably from about 0.001%, more preferably from about 0.005% to about 20%, preferably to about 10%, more preferably to about 5% by weight, of thiodipropionic acid;

b) from about 0.001% to about 90% by weight, of one or more dye fixing agents;

c) from about 0.01% to about 20% by weight, of a fabric abrasion reducing polymer;

d) from about 1% to about 12% by weight, of one or more liquid carriers; and e) the balance water.

Another preferred embodiment comprises:

a) from about 0.0001%, preferably from about 0.001%, more preferably from about 0.005% to about 20%, preferably to about 10%, more preferably to about 5% by weight, of thiodipropionic acid;

b) from about 1% to about 80% by weight, of a fabric softening active c) optionally from about 0.001% to about 90% by weight, of one or more dye fixing agents;

d) optionally from about 0.01% to about 20% by weight, of a fabric abrasion reducing polymer;

e) about 0.005% to about 1% by weight, of one or more crystal growth inhibitors;

f) optionally from about 1% to about 12% by weight, of one or more liquid carriers;

and g) the balance water.

A yet further preferred embodiment comprises:

a) from about 0.0001%, preferably from about 0.001%, more preferably from about 0.005% to about 20%, preferably to about 10%, more preferably to about 5% by weight, of thiodipropionic acid;

b) optionally from about 0.01% to about 10% by weight, of a silicon surfactant c) optionally from about 0.01% to about 10% by weight, of cyclodextrin; and d) the balance water.

Fabric Softening Compositions

The fabric softener compositions of the present invention comprise in addition to the bleach scavenging system or sunfade protection system, a cationic fabric softener system. The fabric softener system is modified depending upon the type of fabric softener composition, inter alia, isotropic liquid, substrate-delivered. The combination of a fabric softening system and a modified polyamine of the present invention is sufficient to provide fabric anti-static and enhanced fabric protection.

Laundry Detergent Compositions

The laundry detergent compositions of the present invention comprise in addition to the bleach scavenging system or sunfade protection system described herein above, a surfactant system. The surfactant system is modified depending upon the type of laundry detergent composition inter alia granular, liquid. The combination of a surfactant and a modified polyamine of the present invention is sufficient to provide cleaning and enhanced fabric protection.

FABRIC SOFTENING SYSTEM

Fabric Softening Actives

The fabric care compositions of the present invention may optionally comprise from about 1%, preferably from about 10%, more preferably from about 20% to about 80%, more preferably to about 60%, most preferably to about 45% by weight, of the composition of one or more fabric softener actives. Fabric softening actives are an essential element of fabric softening compositions.

The preferred fabric softening actives according to the present invention are amines having the formula:

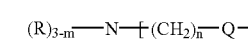

$$(R)_{3-m}-N-[(CH_2)_n-Q-R^1]_m,$$

quaternary ammonium compounds having the formula:

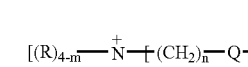

$$[(R)_{4-m}-\overset{+}{N}-[(CH_2)_n-Q-R^1]_m]\quad X^-,$$

and mixtures thereof, wherein each R is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the group consisting of esters, secondary amides, tertiary amides, carbonate, mono carbonyl substituted alkylene, poly carbonyl substituted alkylene, and mixtures thereof, preferably ester or secondary amide; X is a softener compatible anion; the index m has a value of from 1 to 3; the index n has a value of from 1 to 4, preferably 2 or 3, more preferably 2.

The following are non-limiting examples of preferred softener actives according to the present invention.

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium methyl sulfate;

N,N-di(canolyl-oxy-ethyl)-N-methyl, N-(2-hydroxyethyl) ammonium methyl sulfate;

N,N-di(tallowylamidoethyl)-N-methyl, N-(2-hydroxyethyl) ammonium methyl sulfate;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride;

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tri(canolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

A further description of fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al., issued Apr. 28, 1987; U.S. Pat. No. 4,439,335 Bums, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21, 1975; and European Patent Application publication No. 472,178, by Yamamura et al., all of said documents being incorporated herein by reference.

Isotropic Liquids

One type of preferred embodiment of the present invention is the clear, translucent, isotropic liquid fabric softening composition. In order to form said compositions a stabilizing system is necessary, said stabilizing system comprising:

i) from about 0.25%, preferably from about 0.5%, more preferably from about 1%, most preferably from about 1.5% to about 13.5%, preferably to about 10%, more preferably to about 7%, most preferably to about 5% by weight of an organic solvent; and ii) from about 0.25%, preferably from about 0.5%, more preferably from about 1%, most preferably from about 2.5% to about 20%, preferably to about 15%, more preferably to about 12%, still more preferably to about 10%, most preferably to about 8% by weight, of a bilayer modifier.

The following are non-limiting examples of the components which comprise a stabilizing system for clear, translucent, isotropic liquid fabric softening compositions.

Organic/Principal Solvent

A wide range of organic solvents are effective including those heretofore characterized as "principal solvents" which fall within the broadest Clog P limits used to define principal solvents. Modifications of the ClogP ranges can be achieved by adding electrolyte and/or phase stabilizers as taught in copending U.S. patent application Ser. No. 09/309,128, filed May 10, 1999 by Frankenbach, et al.

Principal solvents are selected to minimize solvent odor impact in the composition and to provide a low viscosity to the final composition. For example, isopropyl alcohol is flammable and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 50° F. (about 10° C.), more preferably down to about 40° F. (about 4.4° C.) and are able to recover after storage down to about 20° F. (about 6.7° C.).

Other suitable solvents can be selected based upon their octanol/water partition coefficient (P). Octanol/water partition coefficient of a solvent is the ratio between its equilibrium concentration in octanol and in water. The partition coefficients of the solvent ingredients of this invention are conveniently given in the form of their logarithm to the base 10, log P.

The log P of many ingredients has been reported; for example, the Pomona92 database, available from Daylight Chemical Information Systems, Inc. (Daylight CIS), Irvine, Calif., contains many, along with citations to the original literature. However, the log P values are most conveniently calculated by the "C LOG P" program, also available from Daylight CIS. This program also lists experimental log P values when they are available in the Pomona92 database. The "calculated log P" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The C log P values, which are the most reliable and widely used estimates for this physicochemical property, are preferably used instead of the experimental logP values in the selection of the principal solvent ingredients which are useful in the present invention. Other methods that can be used to compute C log P include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The principal solvents herein are selected from those having a ClogP of from −2.0 to 2.6, preferably from −1.7 to 1.6, and more preferably from −1.0 to 1.0.

The most preferred solvents can be identified by the appearance of the diluted fabric treatment compositions. These diluted compositions comprise vesicular dispersions of fabric softener which contain on average more uni-lamellar vesicles than conventional fabric softener compositions, which contain predominantly multilamellar vesicles. The larger the proportion of uni-lamellar vs. multilamellar vesicles, the better the compositions seem to perform. These compositions provide surprisingly good fabric softening as compared to similar compositions prepared in the conventional way with the same fabric softener active.

Operable solvents have been disclosed, listed under various listings, e.g., aliphatic and/or alicyclic diols with a given number of carbon atoms; monols; derivatives of glycerin; alkoxylates of diols; and mixtures of all of the above can be found in U.S. Pat. No. 5,759,990 Wahl et al., issued Jun. 2, 1998; U.S. Pat. No. 5,747,443 Wahl et al., issued May 5, 1998 and PCT application WO 97/03169 published on 30 Jan. 1997, said patents and application being incorporated herein by reference.

Principal solvents preferred for improved clarity at 50° F. are 2-ethyl-1,3-hexanediol, 1,2-hexanediol; 1,2-pentanediol; hexylene glycol; 1,2-butanediol; 1,4-cyclohexanediol; pinacol; 1,5-hexanediol; 1,6-hexanediol; and/or 2,4-dimethyl-2,4-pentanediol.

Bilayer Modifiers

Bilayer modifiers are compounds which allow the formation of stable formulations at lower and substantially reduced solvent levels even to the point of, surprisingly, eliminating solvent in some compositions.

An advantage of the bilayer modifiers disclosed herein is the lower levels of principal solvents and/or a wider range of principal solvents can be used to provide clarity. For example, without a bilayer modifier, the ClogP of the principal solvent system as disclosed herein would typically be limited to a range of from about 0.15 to about 0.64 as disclosed in U.S. Pat. No. 5,747,443 Wahl et al., issued May 5, 1998. It is known that higher ClogP compounds, up to about 1 can be used when combined with other solvents as disclosed in copending provisional application Serial No. 60/047,058, filed May 19, 1997 and refiled PCT/US98/10167 on May 18, 1998, in the names of H. B. Tordil, E. H. Wahl, T. Trinh, M. Okamoto, and D. L. Duval, or with nonionic surfactants, and especially with the phase stabilizers disclosed herein as previously disclosed in Docket No. 7039P, filed Mar. 2, 1998, Provisional Application Ser. No. 60/076,564, and refiled as, the inventors being D. L. DuVal, G. M. Frankenbach, E. H. Wahl, T. Trinh, H. J. M. Demeyere, J. H. Shaw and M. Nogami. Title: Concentrated, Stable, Translucent or Clear Fabric Softening Compositions, both of said applications being incorporated herein by reference. With the bilayer modifier present, the level of principal solvent can be less and/or the C log P range that is usable is broadened to include from about −2.0 to about 2.6, more preferably from about −1.7 to about 1.6, and even more preferably from about −1.0 to about 1.0.

Fabric softening actives, especially those actives or compositions comprising multiple hydrophobes tend to form bilayers. When these bilayers and the water between the bilayers are sufficiently flexible, the composition can become a single-phase isotropic system comprising a bicontinuous bilayer or sponge phase.

There are many ways to improve flexibility such that single-phase isotropic bicontinuous systems with improved stability are achieved. Using fabric softening actives with low phase transition temperatures enhances flexibility of the bilayer since the actives are fluid. The phase transition temperature can be lowered by several means, for instance by incorporating branching and/or unsaturation in the hydrophobe of fabric softener actives and employing mixtures of fabric softener actives. Using principal solvents, particularly those within the most preferred C log P ranges enhances the flexibility of both the water and the bilayer because these principal solvents, especially in the more preferred ranges, have the ability to migrate between the water where they can break up the water hydrogen bond structure and the bilayer interface where they can promote net zero curvature at the bilayer interface. Net zero curvature is more readily achieved when the head group of an amphiphile (or group of amphiphiles) and the tail moiety of a amphiphile (or group of amphiphiles ) occupy equal or nearly equal volume areas. When the head group and tail moiety area volumes are nearly equal, there is no driving force to cause the surfactant interface to curve in either direction and then the surfactant interface becomes bicontinuous (Surfactants and Interfacial Phenomena, Second Edition, M. J. Rosen). Often cosurfactants are used to make oil in water bicontinuous microemulsions (Surfactants and Interfacial Phenomena, Second Edition, M. J. Rosen). A similar principle operates with fabric softener bilayers. Diquats, by their very nature have large head groups because the two charged amine moieties are both very water miscible and therefore, it is helpful to have a principal solvent that can migrate to the interface acting to 'fill in' for the tail volume, to achieve zero curvature necessary to drive the system into the isotropic bicontinuous phase. Bilayer modifiers can also act as 'fillers' that together with the fabric softener active push the system into a state of zero curvature necessary to drive the system into the isotropic bicontinuous phase. With the appropriate bilayer modifier, the principal solvent or organic solvent can be substantially reduced even to the point, in some cases, of surprisingly eliminating the need to add solvent that is not a part of the polyquaternary, preferably diquaternary, ammonium fabric softening active raw material because the solvent is only necessary to break the water structure and no longer necessary to act as a filler at the fabric softener bilayer surface. Unsaturation and/or branching in the components improves flexibility, thus facilitating the bending of the surface of the bilayer, when necessary.

Bilayer modifiers are highly desired optional components of clear compositions with low solvent or zero added solvent. Preferably these compounds are amphiphilic with a water miscible head group attached to a hydrophobic moiety.

Non-limiting examples of suitable bilayer modifiers include:

i) mono-alkyl cationic amines having the formula:

$$[RN^{+}(R^{1})_{3}]X^{-}$$

wherein R is $C_8$–$C_{22}$ alkyl, preferably $C_{10}$–$C_{18}$ alkyl; $C_8$–$C_{22}$ alkenyl, preferably $C_{10}$–$C_{18}$alkenyl; and mixtures thereof. Each $R^1$ is hydrogen, $C_1$–$C_6$ alkyl, $C_1$–$C_6$ substituted alkyl wherein said substitution is, inter alia, —OH, —$SO_3M$, —$CO_2M$, wherein M is a water soluble cation; benzyl, a polyalkyleneoxy unit having the formula:

$$—(R^2O)_xR^3$$

wherein $R^2$is ethylene, 1,2-propylene, and mixtures thereof, $R^3$ is hydrogen of $C_1$–$C_4$ alkyl, x has the average value of form 2.5 to about 20, preferably 3 to about 10; X is a fabric softener compatible anion.

Examples of preferred mono-alkyl cationic amines are Adogen 461® Varisoft 417®, and Varisoft 471® ex Witco, and Armeen® Z ex Akzo Nobel.

Included in this class of compounds are the $C_8$–$C_{22}$ alkyl choline esters having the formula:

$$[RC(O)OCH_2CH_2N{+}(R^1)_3]X^-$$

wherein R is $C_8$–$C_{22}$ alkyl, preferably $C_{10}$–$C_{18}$ alkyl; $C_8$–$C_{22}$ alkenyl, preferably $C_{10}$–$C_{18}$ alkenyl; and mixtures thereof. Each $R^1$ is hydrogen, $C_1$–$C_6$ alkyl, $C_1$–$C_6$ substituted alkyl wherein said substitution is, inter alia, —OH, —$SO_3M$, —$CO_2M$, wherein M is a water soluble cation; benzyl, a polyalkyleneoxy unit having the formula:

$$—(R^2O)_xR^3$$

wherein $R^2$ is ethylene, 1,2-propylene, and mixtures thereof, $R^3$ is hydrogen of $C_1$–$C_4$ alkyl, x has the average value of form 2.5 to about 20, preferably 3 to about 10; X is a fabric softener compatible anion. Suitable examples of choline esters can be found in U.S. Pat. No. 4,840,738 Hardy et al., issued Jun. 20, 1989 and incorporated herein by reference.

ii) polar and non-polar hydrophobic oils, non-limiting examples of which include, dioctyl adipate: Wickenol® 158 ex Alzo Inc, oleyl oleate: Dermol® OLO ex Alzo Inc. emollients such as fatty esters, e.g. methyl oleates, Wickenols®, derivatives of myristic acid such as isopropyl myristate, and triglycerides such as canola oil; free fatty acids such as those derived from canola oils, fatty alcohols such as oleyl alcohol, bulky esters such as benzyl benzoate and benzyl salicylate, diethyl or dibutyl phthalate; bulky alcohols or diols; and perfume oils particularly low-odor perfume oils such as linalool; mono or poly sorbitan esters; and/or mixtures thereof.

Non-polar hydrophobic oils can be selected from petroleum derived oils such as hexane, decane, pentadecane, dodecane, isopropyl citrate and perfume bulky oils such as limonene, and/or mixtures thereof. In particular, the free fatty acids such as partially hardened canola oil can provide increased softness benefits.

iii) nonionic surfactants selected from the group consisting of alkyl amide alkoxylated nonionic surfactants, alkylaryl nonionic surfactants, alkyl nonionic alkoxylated surfactants, alkoxylated nonionic surfactants comprising bulky head groups, non-alkoxylated nonionic surfactants comprising bulky head groups, block co-polymers obtained by co-polymerization of ethylene oxide and propylene oxide, and mixtures thereof.

a) alkylamide alkoxylated nonionic surfactants. A non-limiting example of an alkyl amide alkoxylated nonionic surfactant suitable for use in the present invention has the formula:

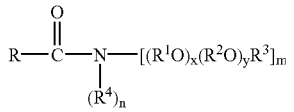

wherein R is $C_7$–$C_{21}$ linear alkyl, $C_7$–$C_{21}$ branched alkyl, $C_7$–$C_{21}$ linear alkenyl, $C_7$–$C_{21}$alkenyl, and mixtures thereof.

$R^1$ is ethylene; $R^2$ is $C_3$–$C_4$ linear alkyl, $C_3$–$C_4$ branched alkyl, and mixtures thereof; preferably $R^2$ is 1,2-propylene. Nonionic surfactants which comprise a mixture of $R^1$ and $R^2$ units preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units is from about 4:1 to about 8:1. Preferably an $R^2$ units (i.e. 1,2-propylene) is attached to the nitrogen atom followed by the balance of the chain comprising from 4 to 8 ethylene units.

$R^3$ is hydrogen, $C_1$–$C_4$ linear alkyl, $C_3$–$C_4$ branched alkyl, and mixtures thereof, preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a —$[(R^1O)_x(R^2O)_yR^3]$ unit.

The index m is 1 or 2, the index n is 0 or 1, provided that when m is equal to 1, n is equal to 1; and when m is 2 n is 0; preferably m is equal to 1 and n is equal to one, resulting in one —$[(R^1O)_x(R^2)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

Suitable means for preparing the polyoxyalkylene alkylamide surface active agents of the present invention can be found in "Surfactant Science Series", Editor Martin Schick, Volume I, Chapter 8 (1967) and Volume XIX, Chapter 1 (1987) included herein by reference. Examples of suitable ethoxylated alkyl amide surfactants are Rewopal® $C_6$ from Witco, Amidox® C5 ex Stepan, and Ethomid® O/17 and Ethomid® HT/60 ex Akzo.

b) alkyl nonionic surfactants:

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having ≦about 50 moles alkylene oxide moieties (e.g. ethylene oxide and/or propylene oxide) per mole of amine. The amine or amine-oxide surfactants for use herein have at least one hydrophobe with from about 6 to about 22 carbon atoms, and are in either straight chain and/or branched chain configuration, preferably there is one hydrocarbon in a straight chain configuration having about 8 to about 18 carbon atoms with one or two alkylene oxide chains attached to the amine moiety, in average amounts of ≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, $C_{25}$, T/25, S/20, S/25 and Ethodumeens® T/20 and T25 from Akzo.

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with ≦about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of ≦about 30 moles of alkylene oxide per alkyl chain, more preferably from about 5 to about 15 moles of alkylene oxide, and most preferably from about 8 to about 12 moles of alkylene oxide. Preferred materials of this class also have pour points of about 70° F. and/or do not solidify in these clear formulations. Examples of alkyl alkoxylated surfactants with straight chains include Neodol® 91–8, 25–9, 1–9, 25–12, 1–9, and 45–13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF. Examples of alkyl-aryl alkoxylated surfactants include Igepalo CO-620 and CO-710, from Rhone Poulenc, Triton® N-111 and N-150 from Union Carbide, Dowfax® 9N5 from Dow and Lutensol® AP9 and AP14, from BASF. A preferred ethoxylated nonionic surfactant is NEODOL 91–8 ex Shell.

c) nonionic surfactants comprising bulky head groups.

Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having ≦about 50, preferably ≦about 30, moles per heterocyclic or carbohydrate head group. The hydrocarbon groups on the carbohydrate or heterocyclic surfactant for use herein have from about 6 to about 22 carbon atoms, and are in either straight chain and/or branched chain configuration. Preferably there is one hydrocarbon having from about 8 to about 18 carbon atoms with one or two alkylene oxide chains carbohydrate or heterocyclic moiety with each alkylene oxide chain present in average amounts of ≦about 50, preferably ≦about 30, per carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

d) block co-polymers

Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Surfactant System

The fabric care compositions of the present invention may optionally comprise one or more detersive surfactants. The laundry detergent compositions of the present invention require at least about 0.01% by weight, preferably from about 0.1% to about 60%, preferably to about 30% by weight, of a detersive surfactant system, said system is comprised of one or more category of surfactants depending upon the embodiment, said categories of surfactants are selected from the group consisting of anionic, cationic, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc.) systems of the present invention, surfactant is preferably present to the extent of from about 0.1% to 60%, preferably to about 30% by weight of the composition.

Nonlimiting examples of surfactants useful herein include:

a) $C_{11}$–$C_{18}$ alkyl benzene sulfonates (LAS);

b) $C_{10}$–$C_{20}$ primary, branched-chain and random alkyl sulfates (AS);

c) $C_{10}$–$C_{18}$ secondary (2,3) alkyl sulfates having the formula:

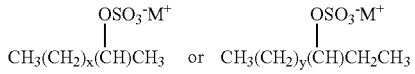

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates ($AE_xS$) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

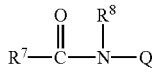

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_nCH_2OH$, $—CH(CH_2OH)(CHOH)_{n-1}CH_2OH$, $—CH_2(CHOH)_2—(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

The laundry detergent compositions of the present invention can also comprise from about 0.001% to about 100% of one or more (preferably a mixture of two or more) mid-chain branched surfactants, preferably mid-chain branched alkyl alkoxy alcohols having the formula:

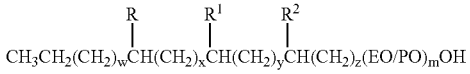

mid-chain branched alkyl sulfates having the formula:

$$CH_3CH_2(CH_2)_wCH(R)(CH_2)_xCH(R^1)(CH_2)_yCH(R^2)(CH_2)_zOSO_3M$$

and mid-chain branched alkyl alkoxy sulfates having the formula:

$$CH_3CH_2(CH_2)_wCH(R)(CH_2)_xCH(R^1)(CH_2)_yCH(R^2)(CH_2)_z(EO/PO)_mOSO_3M$$

wherein the total number of carbon atoms in the branched primary alkyl moiety of these formulae (including the R, $R^1$, and $R^2$ branching, but not including the carbon atoms which comprise any EO/PO alkoxy moiety) is from 14 to 20, and wherein further for this surfactant mixture the average total number of carbon atoms in the branched primary alkyl moieties having the above formula is within the range of greater than 14.5 to about 17.5 (preferably from about 15 to about 17); R, $R^1$, and $R^2$ are each independently selected from hydrogen, $C_1$–$C_3$ alkyl, and mixtures thereof, preferably methyl; provided R, $R^1$, and $R^2$ are not all hydrogen and, when z is 1, at least R or $R^1$ is not hydrogen. M is a water soluble cation and may comprises more than one type of cation, for example, a mixture of sodium and potassium. The index w is an integer from 0 to 13; x is an integer from 0 to 13; y is an integer from 0 to 13; z is an integer of at least 1; provided w+x+y+z is from 8 to 14. EO and PO represent ethyleneoxy units and propyleneoxy units having the formula:

$$-CH(CH_3)CH_2O- \quad \text{or} \quad -CH_2CH(CH_3)O-$$

respectively, however, other alkoxy units inter alia 1,3-propyleneoxy, butoxy, and mixtures thereof are suitable as alkoxy units appended to the mid-chain branched alkyl moieties.

The mid-chain branched surfactants are preferably mixtures which comprise a surfactant system. Therefore, when the surfactant system comprises an alkoxylated surfactant, the index m indicates the average degree of alkoxylation within the mixture of surfactants. As such, the index m is at least about 0.01, preferably within the range of from about 0.1, more preferably from about 0.5, most preferably from about 1 to about 30, preferably to about 10, more preferably to about 5. When considering a mid-chain branched surfactant system which comprises only alkoxylated surfactants, the value of the index m represents a distribution of the average degree of alkoxylation corresponding to m, or it may be a single specific chain with alkoxylation (e.g., ethoxylation and/or propoxylation) of exactly the number of units corresponding to m.

The preferred mid-chain branched surfactants of the present invention which are suitable for use in the surfactant systems of the present invention have the formula:

$$CH_3(CH_2)_aCH(CH_3)(CH_2)_bCH_2(EO/PO)_mOSO_3M$$

or the formula:

$$CH_3(CH_2)_dCH(CH_3)(CH_2)_eCHCH_2(EO/PO)_mOSO_3M$$

wherein a, b, d, and e are integers such that a+b is from 10 to 16 and d+e is from 8 to 14; M is selected from sodium, potassium, magnesium, ammonium and substituted ammonium, and mixtures thereof.

The surfactant systems of the present invention which comprise mid-chain branched surfactants are preferably formulated in two embodiments. A first preferred embodiment comprises mid-chain branched surfactants which are formed from a feedstock which comprises 25% or less of mid-chain branched alkyl units. Therefore, prior to admixture with any other conventional surfactants, the mid-chain branched surfactant component will comprise 25% or less of surfactant molecules which are non-linear surfactants.

A second preferred embodiment comprises mid-chain branched surfactants which are formed from a feedstock which comprises from about 25% to about 70% of mid-chain branched alkyl units. Therefore, prior to admixture with any other conventional surfactants, the mid-chain branched surfactant component will comprise from about 25% to about 70% surfactant molecules which are non-linear surfactants.

The surfactant systems of the laundry detergent compositions of the present invention can also comprise from about 0.001%, preferably from about 1%, more preferably from about 5%, most preferably from about 10% to about 100%, preferably to about 60%, more preferably to about 30% by weight, of the surfactant system, of one or more (preferably a mixture of two or more) mid-chain branched alkyl arylsulfonate surfactants, preferably surfactants wherein the aryl unit is a benzene ring having the formula:

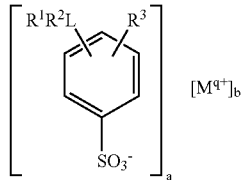

wherein L is an acyclic hydrocarbyl moiety comprising from 6 to 18 carbon atoms; $R^1$, $R^2$, and $R^3$ are each independently hydrogen or $C_1$–$C_3$ alkyl, provided $R^1$ and $R^2$ are not attached at the terminus of the L unit; M is a water soluble cation having charge q wherein a and b are taken together to satisfy charge neutrality.

Optional Ingredients

The fabric conditioning and fabric appearance compositions of the present invention, in addition to one or more linear of cyclic low molecular weight polyamines described herein above, may optionally comprise the following optional ingredients.

Dye Fixing Agents

The compositions of the present invention optionally comprise from about 0.001%, preferably from about 0.5% to about 90%, preferably to about 50%, more preferably to about 10%, most preferably to about 5% by weight, of one or more dye fixing agents.

Dye fixing agents, or "fixatives", are well-known, commercially available materials which are designed to improve the appearance of dyed fabrics by minimizing the loss of dye from fabrics due to washing. Not included within this definition are components which can in some embodiments serve as fabric softener actives.

Many dye fixing agents are cationic, and are based on quaternized nitrogen compound or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy. A preferred dye fixing agent for use in the compositions of the present invention is CARTAFIX CB® ex Clariant.

Other cationic dye fixing agents are described in "After-treatments for Improving the Fastness of Dyes on Textile Fibres", Christopher C. Cook, *Rev. Prog. Coloration*, Vol. XII, (1982). Dye fixing agents suitable for use in the present invention are ammonium compounds such as fatty acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines; derivatives of polymeric alkyldiamines, polyamine-cyanuric chloride condensates, and aminated glycerol dichlorohydrins are suitable for use as dye fixatives in the compositions of the present invention.

Cellulose Reactive Dye Fixing Agents

Another dye fixing agent suitable for use in the present invention are cellulose reactive dye fixing agents. The compositions of the present invention optionally comprise from about 0.01%, preferably from about 0.05%, more preferably from about 0.5% to about 50%, preferably to about 25%, more preferably to about 10% by weight, most preferably to about 5% by weight, of one or more cellulose reactive dye fixing agents. The cellulose reactive dye fixatives may be suitably combined with one or more dye fixatives described herein above in order to comprise a "dye fixative system".

The term "cellulose reactive dye fixing agent" is defined herein as "a dye fixative agent which reacts with the cellulose fibers upon application of heat or upon a heat treatment either in situ or by the formulator". The cellulose reactive dye fixing agents suitable for use in the present invention can be defined by the following test procedure.

Cellulose Reactivity Test (CRT)

Four pieces of fabric which are capable of bleeding their dye (e.g. 10×10 cm of knitted cotton dyed with Direct Red 80) are selected. Two swatches are used as a first control and a second control, respectively. The two remaining swatches are soaked for 20 minutes in an aqueous solution containing 1% (w/w) of the cellulose reactive dye fixing agent to be tested. The swatches are removed and thoroughly dried. One of the treated swatches which has been thoroughly dried, is passed ten times through an ironing calender which is adjusted to a "linen fabric" temperature setting. The first control swatch is also passed ten times through an ironing calender on the same temperature setting.

All four swatches (the two control swatches and the two treated swatches, one of each which has been treated by the ironing calender) are washed separately in Launder-O-Meter pots under typical conditions with a commercial detergent used at the recommended dosage for ½ hour at 60° C., followed by a thorough rinsing of 4 times 200 ml of cold water and subsequently line dried.

Color fastness is then measured by comparing the DE values of a new untreated swatch with the four swatches which have undergone the testing. DE values, the computed color difference, is defined in ASTM D2244. In general, DE values relate to the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space. For the purposes of the present invention, the lower the DE value for a sample, the closer the sample is to the un-tested sample and the greater the color fastness benefit.

As the test relates to selection or a cellulose reactive dye fixing agent, if the DE value for the swatch treated in the ironing step has a value which is better than the two control swatches, the candidate is a cellulose reactive dye fixing agent for the purposes of the invention.

Typically cellulose reactive dye fixing agents are compounds which contain a cellulose reactive moiety, non limiting examples of these compounds include halogeno-triazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity.

Preferred hydroxyethylene urea derivatives include dimethyloldihydroxyethylene, urea, and dimethyl urea glyoxal. Preferred formaldehyde condensation products include the condensation products derived from formaldehyde and a group selected from an amino-group, an imino-group, a phenol group, an urea group, a cyanamide group and an aromatic group. Commercially available compounds among this class are Sandofix WE 56 ex Clariant, Zetex E ex Zeneca and Levogen BF ex Bayer. Preferred polycarboxylates derivatives include butane tetracarboxilic acid derivatives, citric acid derivatives, polyacrylates and derivatives thereof. A most preferred cellulosic reactive dye fixing agents is one of the hydroxyethylene urea derivatives class commercialized under the tradename of Indosol CR ex Clariant. Still other most preferred cellulosic reactive dye fixing agents are commercialized under the tradename Rewin DWR and Rewin WBS ex CHT R. Beitlich.

Chlorine Scavengers

The compositions of the present invention optionally comprise from about 0.01%, preferably from about 0.02%, more preferably from about 0.25% to about 15%, preferably to about 10%, more preferably to about 5% by weight, of a chlorine scavenger. In cases wherein the cation portion and the anion portion of the non-polymeric scavenger each react with chlorine, the amount of scavenger can be adjusted to fit the needs of the formulator.

Suitable chlorine scavengers include ammonium salts having the formula:

$$[(R)_3R^1N]^+X^-$$

wherein each R is independently hydrogen, $C_1$–$C_4$ alkyl, $C_1$–$C_4$ substituted alkyl, and mixtures thereof, preferably R is hydrogen or methyl, more preferably hydrogen. $R^1$ is hydrogen $C_1$–$C_9$ alkyl, $C_1$–$C_9$ substituted alkyl, and mixtures thereof, preferably R is hydrogen. X is a compatible anion, non-limiting examples include chloride, bromide, citrate, sulfate; preferably X is chloride.

Non-limiting examples of preferred chlorine scavengers include ammonium chloride, ammonium sulfate, and mixtures thereof; preferably ammonium chloride.

Crystal Growth Inhibitor

The compositions of the present invention optionally comprise from about 0.005%, preferably from about 0.5%, more preferably from about 0.1% to about 1%, preferably to about 0.5%, more preferably to about 0.25%, most preferably to about 0.2% by weight, of one or more crystal growth inhibitors. The following "Crystal Growth Inhibition Test" is used to determine the suitability of a material for use as a crystal growth inhibitor.

Crystal Growth Inhibition Test (CGIT)

The suitability of a material to serve as a crystal growth inhibitor according to the present invention can be determined by evaluating in vitro the growth rate of certain inorganic micro-crystals. The procedure of Nancollas et al., described in "Calcium Phosphate Nucleation and Growth in Solution", *Prog. Crystal Growth Charact.*, Vol 3, 77–102, (1980), incorporated herein by reference, is a method which is suitable for evaluating compounds for their crystal growth inhibition. The graph of FIG. 1 serves as an example of a plot indicating the time delay (t–lag) in crystal formation afforded by a hypothetical crystal growth inhibitor."

The observed t-lag provides a measure of the compound's efficiency with respect to delaying the growth of calcium phosphate crystal. The greater the t-lag, the more efficient the crystal growth inhibitor.

Exemplary Procedure

Combine in a suitable vessel, 2.1M KCl (35 mL), 0.0175M $CaCl_2$ (5 mL), 0.01M $KH_2PO_4$ (50mL), and de-ionized water (350 mL). A standard pH electrode equipped with a Standard Calomel Reference electrode is inserted and the temperature adjusted to 37° C. while purging of the solution of oxygen. Once the temperature and pH are stabilized, a solution of the crystal growth inhibitor to be test is then added. A typical inhibitor test concentration is $1\times10^{-6}$ M. The solution is titrated to pH 7.4 with 0.05M KOH. The mixture is then treated with 5 mL's of a hydroxyapatite slurry. The hydroxyapatite slurry can be prepared by digesting Bio-Gel® HTP hydroxyapatite powder (100 g) in 1 L of distilled water the pH of which is adjusted to 2.5 by the addition of sufficient 6N HCl and subsequently heating the solution until all of the hydroxyapatite is dissolved (heating for several days may be necessary). The temperature of the solution is then maintained at about 22° C. while the pH is adjusted to 12 by the addition of a solution of 50% aqueous KOH. Once again the solution is heated and the resulting slurry is allowed to settle for two days before the supernatant is removed. 1.5 L of distilled water is added, the solution stirred, then after settling again for 2 days the supernatant is removed. This rinsing procedure is repeated six more time after which the pH of the solution is adjusted to neutrality using 2N HCl. The resulting slurry can be stored at 37° C. for eleven months.

Crystal growth inhibitors which are suitable for use in the present invention have a t-lag of at least 10 minutes, preferably at least 20 minutes, more preferably at least 50 minutes, at a concentration of $1\times10^{-6}$M. Crystal growth inhibitors are differentiated form chelating agents by the fact that crystal growth inhibitors have a low binding affinity of heavy metal ions, i.e., copper. For example, crystal growth inhibitors have an affinity for copper ions in a solution of 0.1 ionic strength when measured at 25° C., of less than 15, preferably less than 12.

The preferred crystal growth inhibitors of the present invention are selected from the group consisting of carboxylic compounds, organic diphosphonic acids, and mixtures thereof. The following are non-limiting examples of preferred crystal growth inhibitors.

Carboxylic Compounds

Non-limiting examples of carboxylic compounds which serve as crystal growth inhibitors include glycolic acid, phytic acid, polycarboxylic acids, polymers and co-polymers of carboxylic acids and polycarboxylic acids, and mixtures thereof. The inhibitors may be in the acid or salt form. Preferably the polycarboxylic acids comprise materials having at least two carboxylic acid radicals which are separated by not more than two carbon atoms (e.g., methylene units). The preferred salt forms include alkali metals; lithium, sodium, and potassium; and alkanolammonium. The polycarboxylates suitable for use in the present invention are further disclosed in U.S. Pat. Nos. 3,128,287, 3,635,830, 4,663,071, 3,923,679; 3,835,163; 4,158,635; 4,120,874 and 4,102,903, each of which is included herein by reference.

Further suitable polycarboxylates include ether hydroxypolycarboxylates, polyacrylate polymers, copolymers of maleic anhydride and the ethylene ether or vinyl methyl ethers of acrylic acid. Copolymers of 1,3,5-trihydroxybenzene, 2,4,6-trisulphonic acid, and carboxymethyloxysuccinic acid are also useful. Alkali metal salts of polyacetic acids, for example, ethylenediamine tetraacetic acid and nitrilotriacetic acid, and the alkali metal salts of polycarboxylates, for example, mellitic acid, succinic acid, oxydisuccinic acid, polymaleic acid, benzene 1,3,5-tricarboxylic acid, carboxymethyloxysuccinic acid, are suitable for use in the present invention as crystal growth inhibitors.

The polymers and copolymers which are useful as crystal growth inhibitors have a molecular weight which is preferably greater than about 500 daltons to about 100,000 daltons, more preferably to about 50,000 daltons.

Examples of commercially available materials for use as crystal growth inhibitors include, polyacrylate polymers Good-Rite® ex BF Goodrich, Acrysol® ex Rohm & Haas, Sokalan® ex BASF, and Norasol® ex Norso Haas. Preferred are the Norasol® polyacrylate polymers, more preferred are Norasol® 410N (MW 10,000) and Norasol® 440N (MW 4000) which is an amino phosphonic acid modified polyacrylate polymer, and also more preferred is the acid form of this modified polymer sold as Norasol® QR 784 (MW 4000) ex Norso-Haas.

Polycarboxylate crystal growth inhibitors include citrates, e.g., citric acid and soluble salts thereof (particularly sodium salt), 3,3-dicarboxy-4-oxa-1,6-hexanedioates and related compounds further disclosed in U.S. Pat. No. 4,566,984 incorporated herein by reference, $C_5$–$C_{20}$ alkyl, $C_5$–$C_{20}$ alkenyl succinic acid and salts thereof, of which dodecenyl succinate, lauryl succinate, myristyl succinate, palmityl succinate, 2-dodecenylsuccinate, 2-pentadecenyl succinate, are non-limiting examples. Other suitable polycarboxylates are disclosed in U.S. Pat. Nos. 4,144,226, 3,308,067 and 3,723,322, all of which are incorporated herein by reference.

Organic Phosphonic Acids

Organic diphosphonic acid are also suitable for use as crystal growth inhibitors. For the purposes of the present invention the term "organic diphosphonic acid" is defined as "an organo-diphosphonic acid or salt which does not comprise a nitrogen atom". Preferred organic diphosphonic acids include $C_1$–$C_4$ diphosphonic acid, preferably $C_2$ diphosphonic acid selected from the group consisting of ethylene diphosphonic acid, α-hydroxy-2 phenyl ethyl diphosphonic acid, methylene diphosphonic acid, vinylidene-1,1-diphosphonic acid, 1,2-dihydroxyethane-1,1-diphosphonic acid, hydroxy-ethane 1,1 diphosphonic acid, the salts thereof, and mixtures thereof. More preferred is hydroxyethane-1,1-diphosphonic acid (HEDP). A preferred is phosphonic acid is 2-phosphonobutane-1,2,4-tricarboxylic acid available as BAYHIBIT AM® ex Bayer.

Fabric Abrasion Reducing Polymers

The herein disclosed polymers provide for decreased fabric abrasion as well as providing a secondary benefit related to dye transfer inhibition. The compositions of the present invention comprise from about 0.01%, preferably from about 0.1% to about 20%, preferably to about 10% by weight, of a fabric abrasion reducing polymer.

The prefered reduced abrasion polymers of the present invention are water-soluble polymers. For the purposes of the present invention the term "water-soluble" is defined as "a polymer which when dissolved in water at a level of 0.2% by weight, or less, at 25° C., forms a clear, isotropic liquid".

The fabric abrasion reducing polymers useful in the present invention have the formula:

$$[—P(D)_m—]_n$$

wherein the unit P is a polymer backbone which comprises units which are homopolymeric or copolymeric. D units are defined herein below. For the purposes of the present invention the term "homopolymeric" is defined as "a polymer backbone which is comprised of units having the same unit composition, i.e., formed from polymerization of the same monomer. For the purposes of the present invention the term "copolymeric" is defined as "a polymer backbone which is comprised of units having a different unit composition, i.e., formed from the polymerization of two or more monomers".

P backbones preferably comprise units having the formula:

$$—[CR_2—CR_2]— \text{ or } —[(CR_2)_x—L]—$$

wherein each R unit is independently hydrogen, $C_1$–$C_{12}$ alkyl, $C_6$–$C_{12}$ aryl, and D units as described herein below; preferably $C_1$–$C_4$ alkyl.

Each L unit is independently selected from heteroatom-containing moieties, non-limiting examples of which are selected from the group consisting of:

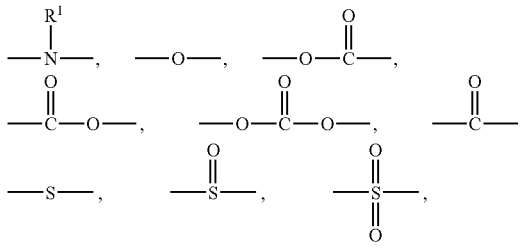

-continued

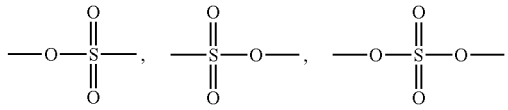

polysiloxane having the formula:

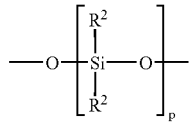

units which have dye transfer inhibition activity:

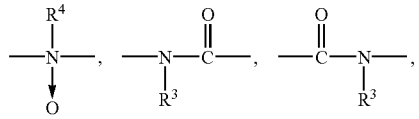

and mixtures thereof, wherein $R^1$ is hydrogen, $C_1$–$C_{12}$ alkyl, $C_6$–$C_{12}$ aryl, and mixtures thereof. $R^2$ is $C_1$–$C_{12}$ alkyl, $C_1$–$C_{12}$ alkoxy, $C_6$–$C_{12}$ aryloxy, and mixtures thereof; preferably methyl and methoxy. $R^3$ is hydrogen $C_1$–$C_{12}$ alkyl, $C_6$–$C_{12}$ aryl, and mixtures thereof; preferably hydrogen or $C_1$–$C_4$ alkyl, more preferably hydrogen. $R^4$ is $C_1$–$C_{12}$ alkyl, $C_6$–$C_{12}$ aryl, and mixtures thereof.

The backbones of the fabric abrasion reducing polymers of the present invention comprise one or more D units which are units which comprise one or more units which provide a dye transfer inhibiting benefit. The D unit can be part of the backbone itself as represented in the general formula:

$$[—P(D)_m—]_n$$

or the D unit may be incorporated into the backbone as a pendant group to a backbone unit having, for example, the formula:

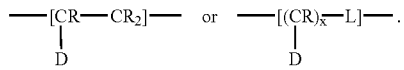

However, the number of D units depends upon the formulation. For example, the number of D units will be adjusted to provide water solubility of the polymer as well as efficacy of dye transfer inhibition while providing a polymer which has fabric abrasion reducing properties. The molecular weight of the fabric abrasion reducing polymers of the present invention are from about 500, preferably from about 1,000, more preferably from about 100,000 most preferably from 160,000 to about 6,000,000, preferably to about 2,000,000, more preferably to about 1,000,000, yet more preferably to about 500,000, most preferably to about 360,000 daltons. Therefore the value of the index n is selected to provide the indicated molecular weight, and providing for a water solubility of least 100 ppm, preferably at least about 300 ppm, and more preferably at least about 1,000 ppm in water at ambient temperature which is defined herein as 25° C.

Polymers Comprising Amide Units

Non-limiting examples of preferred D units are D units which comprise an amide moiety. Examples of polymers wherein an amide unit is introduced into the polymer via a pendant group includes polyvinylpyrrolidone having the formula:

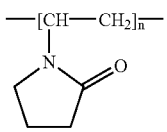

polyvinyloxazolidone having the formula:

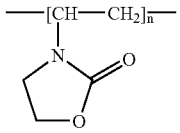

polyvinylmethyloxazolidone having the formula:

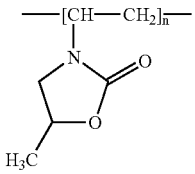

polyacrylamides and N-substituted polyacrylamides having the formula:

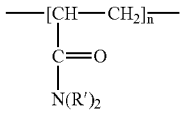

wherein each R' is independently hydrogen, $C_1$–$C_6$ alkyl, or both $R^1$ units can be taken together to form a ring comprising 4–6 carbon atoms; polymethacrylamides and N-substituted polymethacrylamides having the general formula:

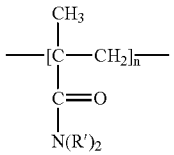

wherein each R' is independently hydrogen, $C_1$–$C_6$ alkyl, or both $R^1$ units can be taken together to form a ring comprising 4–6 carbon atoms; poly(N-acrylylglycinamide) having the formula:

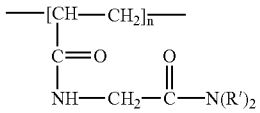

wherein each $R^1$ is independently hydrogen, $C_1$–$C_6$ alkyl, or both $R^1$ units can be taken together to form a ring comprising 4–6 carbon atoms; poly(N-methacrylylglycinamide) having the formula:

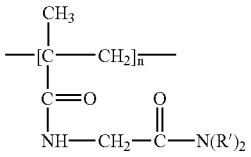

wherein each R' is independently hydrogen, $C_1$–$C_6$ alkyl, or both R' units can be taken together to form a ring comprising 4–6 carbon atoms; polyvinylurethanes having the formula:

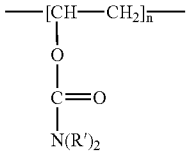

wherein each R' is independently hydrogen, $C_1$–$C_6$ alkyl, or both $R^1$ units can be taken together to form a ring comprising 4–6 carbon atoms.

An example of a D unit wherein the nitrogen of the dye transfer inhibiting moiety is incorporated into the polymer backbone is a poly(2-ethyl-2-oxazoline) having the formula:

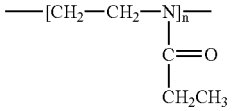

wherein the index n indicates the number of monomer residues present.

The fabric abrasion reducing polymers of the present invention can comprise any mixture of dye transfer inhibition units which provides the product with suitable properties. The preferred polymers which comprise D units which are amide moieties are those which have the nitrogen atoms of the amide unit highly substituted so the nitrogen atoms are in effect shielded to a varying degree by the surrounding non-polar groups. This provides the polymers with an amphiphilic character. Non-limiting examples include polyvinyl-pyrrolidones, polyvinyloxazolidones, N,N-disubstituted polyacrylamides, and N,N-disubstituted polymethacrylamiides. A detailed description of physicochemical properties of some of these polymers are given in "Water-Soluble Synthetic Polymers: Properties and Behavior", Philip Molyneux, Vol. I, CRC Press, (1983) included herein by reference.

The amide containing polymers may be present partially hydrolyzed and/or crosslinked forms. A preferred polymeric compound for the present invention is polyvinylpyrrolidone (PVP). This polymer has an amphiphilic character with a highly polar amide group conferring hydrophilic and polar-attracting properties, and also has non-polar methylene and methine groups, in the backbone and/or the ring, conferring hydrophobic properties. The rings may also provide planar alignment with the aromatic rings in the dye molecules. PVP is readily soluble in aqueous and organic solvent systems. PVP is available ex ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as shown below:

| PVP viscosity average molecular weight (in thousands of daltons) | | | | | |
|---|---|---|---|---|---|
| K-12 | K-15 | K-25 | K-30 | K-60 | K-90 |
| 2.5 | 10 | 24 | 40 | 160 | 360 |

PVP K-12, K-15, and K-30 are also available ex Polysciences, Inc. Warrington, Pa., PVP K-15, K-25, and K-30 and poly(2-ethyl-2-oxazoline) are available ex Aldrich Chemical Co., Inc., Milwaukee, Wis. PVP K30 (40,000) through to K90 (360,000) are also commercially available ex BASF under the tradename Luviskol or commercially available ex ISP. Still higher molecular PVP like PVP 1.3MM, commercially available ex Aldrich is also suitable for use herein. Yet further PVP-type of material suitable for use in the present invention are polyvinylpyrrolidone-co-dimethylaminoethylmethacrylate, commercially available commercially ex ISP in a quaternised form under the tradename Gafquat® or commercially available ex Aldrich Chemical Co. having a molecular weight of approximately 1.0 MM; polyvinylpyrrolidone-co-vinyl acetate, available ex BASF under the tradename Luviskol®, available in vinylpyrrolidone:vinylacetate ratios of from 3:7 to 7:3.

Polymers Comprising N-oxide Units

Another D unit which provides dye transfer inhibition enhancement to the fabric abrasion reducing polymers described herein, are N-oxide units having the formula:

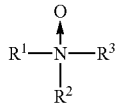

wherein $R^1$, $R^2$, and $R^3$ can be any hydrocarbyl unit (for the purposes of the present invention the term "hydrocarbyl" does not include hydrogen atom alone). The N-oxide unit may be part of a polymer, such as a polyamine, i.e., polyalkyleneamine backbone, or the N-oxide may be part of a pendant group attached to the polymer backbone. An example of a polymer which comprises an the N-oxide unit as a part of the polymer backbone is polyethyleneimine N-oxide. Non-limiting examples of groups which can comprise an N-oxide moiety include the N-oxides of certain heterocycles inter alia pyridine, pyrrole, imidazole, pyrazole, pyrazine, pyrimidine, pyridazine, piperidine, pyrrolidine, pyrrolidone, azolidine, morpholine. A preferred polymer is poly(4-vinylpyridine N-oxide, PVNO). In addition, the N-oxide unit may be pendant to the ring, for example, aniline oxide.

N-oxide comprising polymers of the present invention will preferably have a ratio of N-oxidized amine nitrogen to non-oxidized amine nitrogen of from about 1:0 to about 1:2, preferably to about 1:1, more preferably to about 3:1. The amount of N-oxide units can be adjusted by the formulator. For example, the formulator may co-polymerize N-oxide comprising monomers with non N-oxide comprising monomers to arrive at the desired ratio of N-oxide to non N-oxide amino units, or the formulator may control the oxidation level of the polymer during preparation. The amine oxide unit of the polyamine N-oxides of the present invention have a $Pk_a$ less than or equal to 10, preferably less than or equal to 7, more preferably less than or equal to 6. The average molecular weight of the N-oxide comprising polymers which provide a dye transfer inhibitor benefit to reduced fabric abrasion polymers is from about 500 daltons, preferably from about 100,000 daltons, more preferably from about 160,000 daltons to about 6,000,000 daltons, preferably to about 2,000,000 daltons, more preferably to about 360,000 daltons.

Polymers Comprising Amide Units and N-oxide Units

A further example of polymers which are fabric abrasion reducing polymers which have dye transfer inhibition benefits are polymers which comprise both amide units and N-oxide units as described herein above. Non-limiting examples include co-polymers of two monomers wherein the first monomer comprises an amide unit and the second monomer comprises an N-oxide unit. In addition, oligomers or block polymers comprising these units can be taken together to form the mixed amide/N-oxide polymers. However, the resulting polymers must retain the water solubility requirements described herein above.

Molecular weight

For all the above polymer of the invention, it most preferred that they have a molecular weight in the range as described herein above. This range is typically higher than the range for polymers which render only dye transfer inhibition benefits alone. Indeed, the high molecular weight enables the abrasion occurring subsequent to treatment with the polymer to be reduced, especially in a later washing procedure. Not to be bound by theory, it is believed that that this benefit is partly due to the high molecular weight, thereby enabling the deposition of the polymer on the fabric surface and providing sufficient substantivity that the polymer is able to remain adhered to the fabric during the subsequent use and washing of the fabric. Further, it is believed that for a given charge density, increasing the molecular weight will increase the substantivity of the polymer to the fabric surface. Ideally the balance of charge density and molecular weight will provide both a sufficient rate of deposition onto the fabric surface and a sufficient adherence to the fabric during a subsequent wash cycle. Increasing molecular weight is considered preferable to increasing charge density as it allows a greater choice in the range of materials which are able to provide the benefit and avoids the negative impact that increasing charge density can have such as the attraction of soil and residue onto treated fabrics. It should be noted however that a similar benefit may be predicted from the approach of increasing charge density while retaining a lower molecular weight material.

Solvents or Liquid Carriers

The compositions of the present invention may optionally comprise from about 10%, preferably from about 12%, more preferably from about 14% to about 40%, preferably to about 35%, more preferably to about 25%, most preferably to about 20% by weight of one or more solvents (liquid carriers). These solvents are further disclosed in WO 97/03169 incorporated herein by reference. The use of solvents is especially critical when formulating clear, isotropic liquid fabric conditioning compositions comprising cationic fabric softening actives. The solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a ease of formulation solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about 6.7° C.).

The suitability of any solvent for the formulation of embodiments which are clear isotropic liquids, is surprisingly selective. Suitable solvents can be selected based upon their octanol/water partition coefficient (P) as defined in WO 97/03169. The solvents suitable for use herein are selected from those having a C log P of from about 0.15 to about 0.64, preferably from about 0.25 to about 0.62, and more preferably from about 0.40 to about 0.60, said ease of formulation solvent preferably being at least somewhat asymmetric, and preferably having a melting, or solidification, point that allows it to be liquid at, or near room temperature. Solvents that have a low molecular weight and are biodegradable are also desirable for some purposes. The more asymmetric solvents appear to be very desirable, whereas the highly symmetrical solvents such as 1,7-heptanediol, or 1,4-bis(hydroxymethyl) cyclohexane, which have a center of symmetry, appear to be unable to provide the essential clear compositions when used alone, even though their C log P values fall in the preferred range. Non-limiting examples of solvents include mono-ols, $C_6$ diols, $C_7$ diols, octanediol isomers, butanediol derivatives, trimethylpentanediol isomers, ethylmethylpentanediol isomers, propyl pentanediol isomers, dimethylhexanediol isomers, ethylhexanediol isomers, methylheptanediol isomers, octanediol isomers, nonanediol isomers, alkyl glyceryl ethers, di(hydroxy alkyl) ethers, and aryl glyceryl ethers, aromatic glyceryl ethers, alicyclic diols and derivatives, $C_3$–$C_7$ diol alkoxylated derivatives, aromatic diols, and unsaturated diols. Preferred solvents include 1,2-hexanediol, 2-Ethyl-1,3-hexanediol, and 2,2,4-Trimethyl-1,3-pentanediol.

Enzymes

The compositions and processes herein can optionally employ one or more enzymes inter alia lipases, proteases, cellulase, amylases and peroxidases. A preferred enzyme for use herein is cellulase enzyme. Cellulases usable for use in the fabric enhancement compositions of the present invention include both bacterial and fungal types which preferably exhibit an optimal performance at a pH of from 5 to 9.5. U.S. Pat. No. 4,435,307 Barbesgaard et al., issued Mar. 6, 1984, included herein by reference, discloses suitable fungal cellulases ex *Humicola insolens* or Humicola strain DSM1800 or a cellulase 212-producing fungus belonging to the genus Aeromonas, and cellulase enzymes extracted from the hepatopancreas of a marine mollusk, Dolabella Auricula Solander. Suitable cellulases are also disclosed in GB-A-2.075.028; GB-A-2.095.275 and DE-OS-2.247.832 each of which is included herein by reference. CAREZYME® and CELLUZYME® (Novo) are especially useful. Other suitable cellulases are also disclosed in WO 91/17243 to Novo, WO 96/34092, WO 96/34945 and EP-A-0,739,982. Compositions may comprise up to 5 mg by weight, more typically 0.01 mg to 3 mg, of active enzyme per gram of the composition. Stated otherwise, the compositions herein will typically comprise from 0.001%, preferably from 0.01% to 5%, preferably to 1% by weight, of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Chelant

The compositions of the present invention optionally comprise from about 0.001%, preferably from about 0.01% to about 10%, preferably to about 5%, more preferably to about 3% by weight, of a chelant. Preferred chelants according to the present invention which is preferably used in fabric softening compositions of the present invention is N,N,N',N'-(2-hydroxypropyl)ethylenediamine diethylenetriamine-pentaacetic acid (DTPA) or ethylenediamine-N,N'-disuccinnic acid (EDDS) which can be added during the formation of the fabric softening active or the fabric softening composition. Other suitable chelants are described in U.S. Pat. No. 5,874,396 Littig et al., issued Feb. 23, 1999; and U.S. Pat. No. 5,686,376 Rusche et al., issued Nov. 11, 1997 included herein by reference.

Such water-soluble chelating agents can be selected from the group consisting of amino carboxylates, amino phosphonates, polyfunctionally-substituted aromatic chelating agents and mixtures thereof, all as hereinafter defined and all preferably in their acidic form. Amino carboxylates useful as chelating agents herein include ethylenediamine-tetraacetic acid (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DTPA) and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in rinse-added fabric softener compositions, and include ethylenediaminetetrakis (methylenephosphonates), diethylenetriamine-N,N,N',N", N"-pentakis(methane phosphonate) (DTMP) and 1-hydroxyethane-1,1-diphosphonate (HEDP). Preferably, these amino phosphonates to not contain alkyl or alkenyl groups with more than about 6 carbon atoms.

As can be seen from the foregoing, a wide variety of chelators may be added to the compositions. Indeed, simple polycarboxylates such as citrate, oxydisuccinate, and the like, may also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein.

Polyolefin Dispersion

The compositions of the present invention optionally comprise from about 0.01%, preferably from about 0.1% to about 8%, preferably to about 5%, more preferably to about 3% by weight, of a poly olefin emulsion or suspension in order to provide anti-wrinkle and improved water absorbency benefits to the fabrics treated by the fabric care compositions of the present invention. Preferably, the polyolefin is a polyethylene, polypropylene or mixtures thereof. The polyolefin may be at least partially modified to contain various functional groups, such as carboxyl, carbonyl, ester, ether, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

When considering ease of formulation, the polyolefin is preferably introduced as a suspension or an emulsion of polyolefin dispersed by use of an emulsifying agent. The polyolefin suspension or emulsion preferably has from 1, preferably from 10%, more preferably from 15% to 50%, more preferably to 35% more preferably to 30% by weight, of polyolefin in the emulsion. The polyolefin preferably has a molecular weight of from 1,000, preferably from 4,000 to 15,000, preferably to 10,000. When an emulsion is employed, the emulsifier may be any suitable emulsification or suspending agent. Preferably, the emulsifier is a cationic, nonionic, zwitterionic or anionic surfactant or mixtures thereof. Most preferably, any suitable cationic, nonionic or anionic surfactant may be employed as the emulsifier. Preferred emulsifiers are cationic surfactants such as the fatty amine surfactants and in particular the ethoxylated fatty amine surfactants. In particular, the cationic surfactants are preferred as emulsifiers in the present invention. The polyolefin is dispersed with the emulsifier or suspending agent in a ratio of emulsifier to polyolefin of from 1:10 to 3:1. Preferably, the emulsion includes from 0.1, preferably from 1%, more preferably from 2.5% to 50%, preferably to 20%, more preferably to 10% by weight, of emulsifier in the polyolefin emulsion. Polyethylene emulsions and suspensions suitable for use in the present invention are available under the tradename VELUSTROL exHOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention.

Stabilizers

The compositions of the present invention can optionally comprise from about 0.01%, preferably from about 0.035% to about 0.2%, more preferably to about 0.1% for antioxidants, preferably to about 0.2% for reductive agents, of a stabilizer. The term "stabilizer," as used herein, includes antioxidants and reductive agents. These agents assure good odor stability under long term storage conditions for the compositions and compounds stored in molten form. The use of antioxidants and reductive agent stabilizers is especially critical for low scent products (low perfume). Non-limiting examples of antioxidants that can be added to the compositions of this invention include a mixture of ascorbic acid, ascorbic palmitate, propyl gallate, ex Eastman Chemical Products, Inc., under the trade names Tenox® PG and Tenox S-1; a mixture of BHT (butylated hydroxytoluene), BHA (butylated hydroxyanisole), propyl gallate, and citric acid, ex Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox(1425, Irganox® 3114, and mixtures thereof; more preferably Irganox® 3125 alone or mixed with citric acid and/or other chelators such as isopropyl citrate, Dequest® 2010, ex Monsanto with a chemical name of 1-hydroxyethylidene-1, 1-diphosphonic acid (etidronic acid), and Tiron®, ex Kodak with a chemical name of 4,5-di-hydroxy-m-benzenesulfonic acid/sodium salt, EDDS, and DTPA®, ex Aldrich with a chemical name of diethylenetriaminepentaacetic acid.

Hydrophobic Dispersant

A preferred composition of the present invention comprises from about 0.1%, preferably from about 5%, more preferably form about 10% to about 80%, preferably to about 50%, more preferably to about 25% by weight, of a hydrophobic polyamine dispersant having the formula:

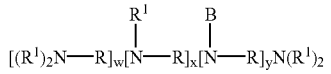

wherein R, $R^1$ and B are suitably described in U.S. Pat. No. 5,565,145 Watson et al., issued Oct. 15, 1996 incorporated herein by reference, and w, x, and y have values which provide for a backbone prior to substitution of preferably at least about 1200 daltons, more preferably 1800 daltons.

$R^1$ units are preferably alkyleneoxy units having the formula:

$$—(CH_2CHR'O)_m(CH_2CH_2O)_nH$$

wherein R' is methyl or ethyl, m and n are preferably from about 0 to about 50, provided the average value of alkoxylation provided by m+n is at least about 2, preferably 4.

A further description of polyamine dispersants suitable for use in the present invention is found in U.S. Pat. No. 4,891,160 Vander Meer, issued Jan. 2, 1990; U.S.4,597,898, Vander Meer, issued Jul. 1, 1986; European Patent Application 111,965, Oh and Gosselink, published Jun. 27, 1984; European Patent Application 111,984, Gosselink, published Jun. 27, 1984; European Patent Application 112,592, Gosselink, published Jul. 4, 1984; U.S. Pat. No. 4,548,744, Connor, issued Oct. 22, 1985; and U.S. Pat. No. 5,565,145 Watson et al., issued Oct. 15, 1996; all of which are included herein by reference. However, any suitable clay/soil dispersent or anti-redepostion agent can be used in the laundry compositions of the present invention.

Electrolyte

The fabric softening embodiments of the compositions of the present invention, especially clear, isotropic liquid fabric softening compositions, may also optionally, but preferably comprise, one or more electrolytes for control of phase stability, viscosity, and/or clarity. For example, the presence of certain electrolytes inter alia calcium chloride, magnesium chloride may be key to insuring initial product clarity and low viscosity, or may affect the dilution viscosity of liquid embodiments, especially isotropic liquid embodiments. Not wishing to be limited by theory, but only wishing to provide an example of a circumstance wherein the formulator must insure proper dilution viscosity, includes the following example. Isotropic or non-isotropic liquid fabric softener compositions can be introduced into the rinse phase of laundry operations via an article of manufacture designed to dispense a measured amount of said composition. Typically the article of manufacture is a dispenser which delivers the softener active only during the rinse cycle. These dispensers are typically designed to allow an amount of water equal to the volume of softener composition to enter into the dispenser to insure complete delivery of the softener composition. An electrolyte may be added to the compositions of the present invention to insure phase stability and prevent the diluted softener composition from "gelling out" or from undergoing an undesirable or unacceptable viscosity increase. Prevention of gelling or formation of a "swelled", high viscosity solution insures thorough delivery of the softener composition.

However, those skilled in the art of fabric softener compositions will recognize that the level of electrolyte is also influenced by other factors inter alia the type of fabric softener active, the amount of principal solvent, and the level and type of nonionic surfactant. For example, triethanol amine derived ester quaternary amines suitable for use as softener actives according to the present invention are typically manufactured in such a way as to yield a distribution of mono-, di-, and tri- esterified quaternary ammonium compounds and amine precursors. Therefore, as in this example, the variability in the distribution of mono-, di-, and tri- esters and amines may predicate a different level of electrolyte. Therefore, the formulator must consider all of the ingredients, namely, softener active, nonionic surfactant, and in the case of isotropic liquids, the principal solvent type and level, as well as level and identity of adjunct ingredients before selecting the type and/or level of electrolyte A wide variety of ionizable salts can be used. Examples of suitable salts are the halides of the Group IA and IIA metals of the Periodic Table of the elements, e.g., calcium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 5,000 ppm, of the composition.

Alkylene polyammonium salts can be incorporated into the composition to give viscosity control in addition to or in place of the water-soluble, ionizable salts above, In addition, these agents can act as scavengers, forming ion pairs with anionic detergent carried over from the main wash, in the rinse, and on the fabrics, and can improve softness performance. These agents can stabilized the viscosity over a broader range of temperature, especially at low temperatures, compared to the inorganic electrolytes. Specific examples of alkylene polyammonium salts include L-lysine, monohydrochloride and 1,5-diammonium 2-methyl pentane dihydrochloride.

Cationic Charge Booster System

The compositions of the present invention may optionally comprise from about 0.2%, preferably from about 5% to about 10%, preferably to about 7% by weight, of a charge booster system. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition. This is especially true in clear, translucent, isotropic compositions.

Cationic Charge Booster Admixtures

One type of preferred cationic charge booster system of the present invention is an admixture of two or more di-amino compounds wherein at least one of said di-amino compounds is a di-quaternary ammonium compound.

Preferably said charge booster system is the admixture of di-amino compounds which results from a process comprising the steps of:

i) reacting one equivalent of a diamine having the formula:

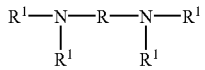

wherein R is $C_2$–$C_{12}$ alkylene; each $R^1$ is independently hydrogen, $C_1$–$C_4$ alkyl, a unit having the formula:

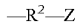

wherein $R^2$ is $C_2$–$C_6$ linear or branched alkylene, $C_2$–$C_6$ linear or branched hydroxy substituted alkylene, $C_2$–$C_6$ linear or branched amino substituted alkylene, and mixtures thereof; Z is hydrogen, —OH, —$NH_2$, and mixtures thereof; with from about 0.1 equivalent to about 8 equivalents of an acylating unit to form an acylated di-amino admixture; and ii) reacting said acylated di-amino admixture with from 0.1 equivalents to 2 equivalents of a quaternizing agent to form said cationic charge booster system.

Step (i) of the present cationic charge booster producing process, is an acylation step. The acylation of the amino compound may be conducted under any conditions which allow the formulator to prepare the desired final cationic admixture or an admixture which has the desired final charge boosting properties.

Step (ii) of the present cationic charge booster producing process, is the quaternization step. The formulator may use any quaternizing agent which provides an admixture having the desired charge boosting properties. The choice of from 0.1 equivalents to 2 equivalents of quaternizing agent will provide the formulator with a wide array of cationically charged di-amines in the final admixture.

Non-limiting examples of acylating agents suitable for use in the present invention include, acylating agents selected from the group consisting of:

a) acyl halides having the formula:

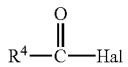

b) an ester having the formula:

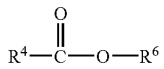

c) anhydrides having the formula:

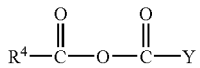

d) carboxylic/carbonic anhydrides having the formula:

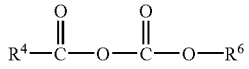

e) acyl azides having the formula:

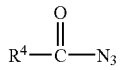

f) and mixtures thereof;

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; Hal is a halogen selected from chlorine, bromine, or iodine; $R^6$ is $R^4$, $C_1$–$C_5$ linear or branched alkyl; Y is $R^4$, —$CF_3$, —$CCl_3$, and mixtures thereof.

An example of a preferred process comprises the reaction of an amine having the formula:

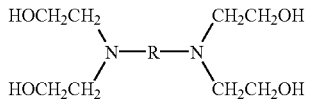

wherein R is hexamethylene, with about two equivalents of an acylating agent to form a partially acylated diamine admixture, followed by reaction of said admixture with from about 1.25 to about 1.75 equivalents of a quaternizing unit, preferably dimethyl sulfate.

Non-limiting examples of preferred di-amines which comprise the cationic charge booster systems of the present invention include:

i) one or more diamines having the formula:

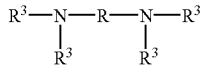

ii) one or more quaternary ammonium compounds having the formula:

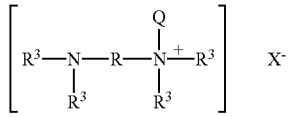

iii) one or more di-quaterary ammonium compounds having the formula:

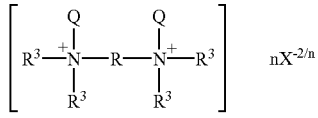

wherein R is $C_2$–$C_{12}$ alkylene, preferably $C_2$–$C_{12}$ alkylene, more preferably hexamethylene; each $R^3$ is independently $R^1$, an acyl comprising unit having the formula:

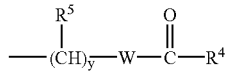

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; and mixtures thereof; each $R^5$ is independently hydrogen, —OH, —$NH_2$, —$(CH_2)$,$WC(O)R^4$, and mixtures thereof; Q is a quaternizing unit selected from the group consisting of $C_1$–$C_{12}$ alkyl, benzyl, and mixtures thereof; W is —O—, —NH—, and mixtures thereof; X is a water soluble cation; the index n is 1 or 2; y is from 2 to 6; z is from 0 to 4; y+z is less than 7.

Suitable sources of acyl units which comprise the cationic charge booster systems include acyl units which are derived from sources of triglycerides selected from the group consisting of tallow, hard tallow, lard, coconut oil, partially hydrogenated coconut oil, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks and mixtures thereof Preferably at least two $R^3$ units are units having the formula;

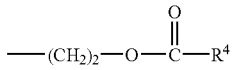

wherein $R^4$ comprises an acyl which is derived from a triglyceride source selected from the group consisting of hard tallow, soft tallow, canola, oleoyl, and mixtures thereof; Q is methyl; X is a water soluble cation; the index n is 2.

The following is an example of a di-amino admixture suitable for use as a cationic charge boosting system according to the present invention.

i) diamines having the formula:

$(HOCH_2CH_2)_2N(CH_2)_6N(CH_2CH_2OH)_2$ $(HOCH_2CH_2)_2N(CH_2)_6N(CH_2CH_2OH)(CH_2CH_2OCR^4)$ $(R^4COCH_2CH_2)(HOCH_2CH_2)N(CH_2)_6N(CH_2CH_2OH)(CH_2CH_2OCR^4)$ $(R^4COCH_2CH_2)(HOCH_2CH_2)N(CH_2)_6N(CH_2CH_2OCR^4)_2$ $(R^4COCH_2CH_2)(HOCH_2CH_2)N(CH_2)_6N(CH_2CH_2OH)_2$ $(R^4COCH_2CH_2)_2N(CH_2)_6N(CH_2CH_2OCR^4)_2$ ii) quaternary ammonium compounds having the formula:

$(HOCH_2CH_2)_2N^+(CH_3)(CH_2)_6N(CH_2CH_2OH)_2$ $(HOCH_2CH_2)_2N^+(CH_3)(CH_2)_6N(CH_2CH_2OH)(CH_2CH_2OCR^4)$ $(R^4COCH_2CH_2)(HOCH_2CH_2)N^+CH_3)(CH_2)N(CH_2CH_2CH_2OH)_2$ $(R^4COCH_2CH_2)(HOCH_2CH_2)N^+(CH_3)(CH_2)_6N(CH_2CH_2OH)(CH_2CH_2OCR^4)$ $(HOCH_2CH_2)_2N^+(CH_3)(CH_2)_6N(CH_2CH_2OCR^4)_2$ $(R^4COCH_2CH_2)_2N^+(CH_3)(CH_2)_6N(CH_2CH_2OH)_2$ $(R^4COCH_2CH_2)_2N^+(CH_3)(CH_2)_6N(CH_2CH_2OH)(CH_2CH_2OCR^4)$ $(R^4COCH_2CH_2)(HOCH_2CH_2)N^+(CH_3)(CH_2)_6N(CH_2CH_2OCR^4)_2$ $(R^4COCH_2CH_2)_2N^+(CH_3)(CH_2)_6N(CH_2CH_2OCR^4)_2$ iii) di-quaternary ammonium compounds having the formula:

$(HOCH_2CH_2)_2N^+(CH_3)(CH_2)_6N^+(CH_3)(CH_2CH_2OH)_2$ $(R^4COCH_2CH_2)(HOCH_2CH_2)N^+(CH_3)(CH_2)_6N^+(CH_3)(CH_2CH_2OH)_2$ $(R^4COCH_2CH_2)(HOCH_2CH_2)N^+(CH_3)(CH_2)_6N^+$ $(CH_3)(CH_2CH_2OH)(CH_2OCR^4)$ $(R^4COCH_2CH_2)_2N^+(CH_3)(CH_2)_6N^+(CH_3)(CH_2CH_2OCR^4)_2$ wherein the acyl unit —C(O)$R^4$ is derived from canola.

Non-admixture Cationic Charge Boosters

When formulating non-admixture cationic charge booster systems into the fabric enhancement or fabric care compositions of the present invention, the following are non-limiting preferred examples.

i) Quaternary Ammonium Compounds

A preferred composition of the present invention comprises at least about 0.2%, preferably from about 0.2% to about 10%, more preferably from about 0.2% to about 5% by weight, of a cationic charge booster having the formula:

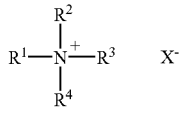

wherein $R^1$, $R^2$, $R^3$, and $R^4$ are each independently $C_1$–$C_{22}$ alkyl, $C_3$–$C_{22}$ alkenyl, $R^5$—Q—$(CH_2)_m$—, wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl, $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5$—Q—$(CH_2)_m$— moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—Q—$(CH_2)_m$— moiety has the formula:

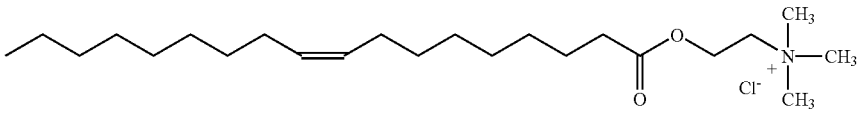

wherein $R^5$—Q— is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

ii) Polyvinyl Amines

A preferred embodiment of the present invention contains at least about 0.2%, preferably from about 0.2% to about 5%, more preferably from about 0.2% to about 2% by weight, of one or more polyvinyl amines having the formula

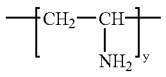

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amnine backbone —$NH_2$ unit hydrogens can be substituted by an alkyleneoxy unit having the formula:

$$—(R^1O)_xR^2$$

wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

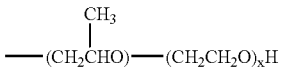

wherein x has the value of from 1 to about 50. Substitutions such as the above are represented by the abbreviated formula PO–$EO_x$—. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

iii) Poly-Quaternary Ammonium Compounds

A preferred composition of the present invention comprises at least about 0.2%, preferably from about 0.2% to about 10%, more preferably from about 0.2% to about 5% by weight, of a cationic charge booster having the formula:

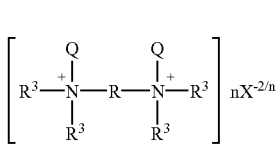

wherein R is $C_2$–$C_{12}$ alkylene, preferably $C_2$–$C_8$ alkylene, more preferably hexamethylene; each $R^3$ is independently $R^1$, an acyl comprising unit having the formula:

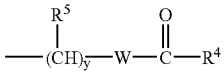

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; and mixtures thereof; each $R^5$ is independently hydrogen, —OH, —$NH_2$, —$(CH_2)_2WC(O)R^4$, and mixtures thereof; Q is a quaternizing unit selected from the group consisting of $C_1$–$C_{12}$ alkyl, benzyl, and mixtures thereof; W is —O—, —NH—, and mixtures thereof; X is a water soluble cation; the index n is 1 or 2; y is from 2 to 6; z is from 0 to 4; y+z is less than 7.

An example of a fabric softener cationic booster comprising a —$(CH_2)_z$ $WC(O)R^4$ moiety has the formula:

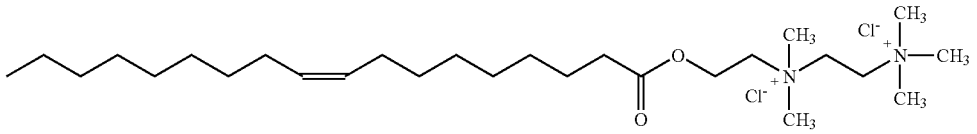

wherein $R^3$ is methyl or —$(CH_2)_zWC(O)R^4$, Q is methyl, W is oxygen, the index z is equal to 2, such that —$WC(O)R^4$ is an oleoyl unit.

Cationic Nitrogen Compounds

The fabric enhancement compositions of the present invention may optionally comprise from about 0.5%, preferably from about 1% to about 10%, preferably to about 5% by weight, of one or more cationic nitrogen containing compound, preferably a cationic compound having the formula:

$$\left[R—\overset{+}{N}(R^1)_3\right] X^-$$

wherein R is $C_{10}$–$C_{18}$ alkyl, each $R^1$ is independently $C_1$–$C_4$ alkyl, X is a water soluble anion; preferably R is $C_{12}$–$C_{14}$, preferably $R^1$ is methyl. Preferred X is halogen, more preferably chlorine. Examples of cationic nitrogen compounds suitable for use in the fabric care compositions of the present invention are Non-limiting examples of preferred cationic nitrogen compounds are N,N-dimethyl-(2-hydroxyethyl)-N-dodecyl ammonium bromide, N,N-dimethyl-(2-hydroxyethyl)-N-tetradecyl ammonium bromide. Suitable cationic nitrogen compounds are available ex Akzo under the tradenames Ethomeen T/15®, Secomine TA15®, and Ethoduomeen T/20®.

Builders

The laundry detergent compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

The level of builder can vary widely depending upon the end use of the composition and its desired physical form. When present, the compositions will typically comprise at least about 1% builder. Formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO:_2:Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y]xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "poly-carboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally Iresult in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111,984 Gosselink, published Jun. 27, 1984; European Patent Application 112,592 Gosselink, published Jul. 4, 1984; U.S. Pat. No. 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

In addition, polymeric dispersing agents which include polymeric polycarboxylates and polyethylene glycols, are suitable for use in the present invention. Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

The following, all included herein by reference, describe soil release polymers suitable for use in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat. No. 711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al; U.S. Pat. No. 4,240,918 Lagasse et al.; U.S. Pat. No. 4,525,524 Tung et al.; U.S. Pat. No. 4,579,681 Ruppert et al.; U.S. Pat. Nos. 4,220,918; 4,787,989; EP 279,134 A, 1988 to Rhone-Poulenc Chemie; EP 457,205 A to BASF (1991); and U.S. Pat. No. DE 2,335,044 to Unilever N. V., 1974; all incorporated herein by reference.

Method of Use

The present invention further relates to a method for providing bleach protection to fabric, said method comprising the step of contact fabric in need of cleaning with a composition according to the present invention.

For the purposes of the present invention the term "contacting" is defined as "intimate contact of a fabric with an aqueous solution of a composition which comprises:

a) from 0.01% by weight, of a bleach scavenging system, said system comprising:
   i) optionally, one or more organic sulfur compounds having the formula:

R—S—R or R—S—S—R wherein each R is independently hydrogen, $C_2$–$C_{20}$ linear or branched, substituted or unsubstituted alkyl; provided at least one R unit is not hydrogen;
   ii) optionally, one or more inorganic sulfur compounds selected from the group consisting of the sodium, potassium, lithium, calcium, and nmagnesium salts of metabisulfite, thiosulfate, sulfite, bisulfite, and mixtures thereof; and b) the balance carriers and other adjunct ingredients wherein said composition is present in an amount of at least 10 ppm, preferably at least 100 ppm". Contacting typically occurs by soaking, washing, rinsing, spraying the composition onto fabric, but can also include contact of a substrate inter alia a material onto which the composition has been absorbed, with the fabric. Laundering is a preferred process. Temperatures for laundering can take place at a variety of temperatures, however, laundering typically occurs at a temperature less than about 30° C., preferably from about 5° C. to about 25° C.

The present invention further relates to methods for preventing loss of fabric color due to sunlight, said method comprising the step of contacting fabric which will be exposed to sunlight with a composition comprising:

a) from about 0.0001%, preferably from about 0.001%, more preferably from about 0.005% to about 20%, preferably to about 10%, more preferably to about 5% by weight, of a sunlight protection system, said system comprising:
   i) one or more organic sulfur compounds having the formula:

R—S—R or R—S—S—R wherein each R is independently hydrogen, $C_2$–$C_{20}$ linear or branched, substituted or unsubstituted alkyl; provided at least one R unit is not hydrogen;
   ii) optionally, one or more inorganic sulfur compounds selected from the group consisting of the sodium, potassium, lithium, calcium, and magnesium salts of metabisulfite, thiosulfate, sulfite, bisulfite, and mixtures thereof; and b) the balance carriers and adjunct ingredients.

The following are non-limiting example of the present invention.

TABLE 1

| Ingredients | weight % | | | | | | |
|---|---|---|---|---|---|---|---|
| | 1 | 2 | 3 | 4 | 5 | 6 | 7 |
| Polymer[1] | 3.5 | 2.0 | 4.5 | 4.5 | 3.5 | 3.5 | 4.5 |
| Dye fixative[2] | 2.4 | 1.0 | 2.4 | 2.4 | 2.0 | 2.4 | 2.4 |
| Bayhibit AM[3] | 1.0 | 0.3 | 1.0 | 1.0 | 1.0 | 1.0 | 1.0 |
| Bleach scavenger[4] | 10.0 | 5.0 | 10.0 | 5.0 | 8.0 | 15.0 | 15.0 |
| Water & minors | balance | balance | balance | balance | balance | balance | balance |

[1]Fabric abrasion reducing polymer polyvinylpyrrolidone K85 available ex BASF under the tradename Luviskol K85 ®.
[2]Dye fixing agent ex Clariant under the tradename Cartafix CB ®.
[3]2-Phosphonobutane-1,2,4-tricarboxylic acid ex Bayer.
[4]Cystamine hydrochloride.

TABLE II

| Ingredients | weight % | | | | | | |
|---|---|---|---|---|---|---|---|
| | 8 | 9 | 10 | 11 | 12 | 13 | 14 |
| Polymer[1] | 4.5 | 3.5 | 4.5 | 3.5 | — | 3.5 | 5.0 |
| Dye fixative[2] | 2.4 | 2.0 | 2.0 | — | 2.4 | 2.4 | 2.4 |
| Bayhibit AM[3] | 1.0 | 1.0 | 0.5 | 1.0 | 1.0 | 1.0 | — |
| Polyamine[4] | — | — | — | — | — | — | 8.0 |
| HEDP[5] | — | — | — | — | — | — | 0.75 |
| Armosoft[6] | — | — | — | — | — | — | 2.0 |
| Bleach scavenger[7] | 10.0 | 15.0 | 8.0 | — | — | — | — |
| Bleach scavenger[8] | — | — | — | 15.0 | 15.0 | — | — |
| Bleach scavenger[9] | — | — | — | — | — | 10.0 | — |
| Bleach scavenger[10] | — | — | — | — | — | — | 1.0 |
| Water & minors | balance | balance | balance | balance | balance | balance | balance |

[1]Fabric abrasion reducing polymer polyvinylpyrrolidone K85 available ex BASF under the tradename Luviskol K85 ®.
[2]Dye fixing agent ex Clariant under the tradename Cartafix CB ®.
[3]2-Phosphonobutane-1,2,4-tricarboxylic acid ex Bayer.
[4]1,1-N-dimethyl-9,9-N"-dimethyl dipropylenetriamine.
[5]Hydroxyethylidene diphosphoric acid.
[6]$C_{12}$ trimethyl ammonium chloride.
[7]Cystamine hydrochloride.
[8]Magnesium thiosulfate.
[9]Bis diethyleneaminoethyl disufide dihydrochloride.
[10]3,3'-thiodipropionic acid.

TABLE III

| Ingredients | weight % | | | | |
|---|---|---|---|---|---|
| | 15 | 16 | 17 | 18 | 19 |
| High MW SPE[1] | 0.75 | 1.50 | 0.75 | 1.50 | 1.50 |
| Superwetter[2] | 0.75 | 0.75 | 1.50 | 0.75 | 0.75 |
| Luviflex Soft[3] | 0.20 | 0.40 | 0.40 | 0.70 | 0.70 |
| Ethanol | 3.00 | 3.00 | 3.00 | 3.00 | 3.00 |
| Cyclodextrin[4] | 0.30 | 0.30 | 0.30 | 0.30 | 0.30 |
| Sunlight Protector[5] | 0.0001 | 0.01 | 1.00 | 5.0 | 10.0 |
| Perfume | 0.01 | 0.01 | 0.01 | 0.01 | 0.01 |
| Proxel[6] | 0.015 | 0.015 | 0.015 | 0.015 | 0.015 |
| Water & minors | balance | balance | balance | balance | balance |

[1]Dow Corning ® 190 or Silwet ® L7001: Silicone copolyol.
[2]Dow Corning ® Q2-5211 or Silwet ® L77: 84% Polyalkyleneoxide modified heptamethyltrisiloxane and 16% Allyloxypolyethyleneglycol methyl ether.
[3]Copolymer of methacrylic acid and ethyl acrylate.
[4]Hydroxypropyl-β-cyclodextrin and/or methylated cyclodextrin.
[5]3,3'-Thio-di-propionic acid.
[6]20% 1,2-Benzisothiazolin in aqueous dipropylene glycol.

TABLE IV

| Ingredients | weight % | | | | |
|---|---|---|---|---|---|
| | 20 | 21 | 22 | 23 | 24 |
| Softener Active[1] | 28.0 | 28.0 | 28.0 | 28.0 | 28.0 |
| Hexyleneglycol | 2.47 | 2.47 | 2.47 | 2.47 | 2.47 |
| Ethanol | 2.47 | 2.47 | 2.47 | 2.47 | 2.47 |
| 2-Ethyl-1,3-hexandiol | 8.0 | 8.0 | 8.0 | 8.0 | 8.0 |
| HEDP[2] | 0.05 | 0.05 | 0.05 | 0.05 | 0.05 |
| Coco amide | 1.65 | 1.65 | 1.65 | 1.65 | 1.65 |
| Sunlight protector[3] | 0.10 | 1.00 | 2.00 | 5.00 | 10.0 |
| Perfume | 0.3 | 0.3 | 0.3 | 0.3 | 0.3 |
| $CaCl_2$ | 0.1 | 0.1 | 0.1 | 0.1 | 0.1 |
| HCl | 0.01 | 0.01 | 0.01 | 0.01 | 0.01 |
| Acid Blue 80 | 0.001 | 0.001 | 0.001 | 0.001 | 0.001 |
| Pro-perfume[4] | 0.25 | 0.35 | 0.5 | — | 0.25 |
| Pro-perfume[5] | — | — | — | 0.3 | 0.25 |
| Demineralized water | Bal. | Bal. | Bal. | Bal. | Bal. |

[1]N,N-di-(canolyl-oxy-ethyl)-N-methyl-N-(2-hydroxyethyl)ammonium methyl sulfate
[2]1-hydroxyethane-1,1-diphosphonate
[3]3,3'-Thio-di-propionic acid.
[4]Digeranyl succinate.
[5]Linalyl (naphtoyl) acetate[4]

TABLE V

| Ingredients | weight % | | | | |
|---|---|---|---|---|---|
| | 25 | 26 | 27 | 28 | 29 |
| LAS[1] | 22.86 | 22.86 | 22.86 | 22.86 | 22.86 |
| FAS[2] | 4.04 | 4.04 | 4.04 | 4.04 | 4.04 |
| Surfactant[3] | 1.16 | 1.16 | 1.16 | 1.16 | 1.16 |
| Polymer[4] | 10.67 | 10.67 | 10.67 | 10.67 | 10.67 |
| Layered Silicate | 5.50 | 5.50 | 5.50 | 5.50 | 5.50 |
| Zeolite-A | 8.26 | 8.26 | 8.26 | 8.26 | 8.26 |
| Sunlight Protector[5] | 0.10 | 1.00 | 5.00 | 10.00 | 15.00 |
| Carbonate | 15.94 | 15.94 | 15.94 | 15.94 | 15.94 |
| Silicate (2.0 R) | 11.64 | 11.64 | 11.64 | 11.64 | 11.64 |
| Sulfate | 0.39 | 0.39 | 0.39 | 0.39 | 0.39 |
| Protease | 0.40 | 0.40 | 0.40 | 0.40 | 0.40 |
| NOBS[6] | 2.70 | 2.70 | 2.70 | 2.70 | 2.70 |
| SPC[7] | 3.16 | 3.16 | 3.16 | 3.16 | 3.16 |
| Polymer[8] | 0.16 | 0.16 | 0.16 | 0.16 | 0.16 |
| PEG 4000[9] | 0.18 | 0.18 | 0.18 | 0.18 | 0.18 |
| Water/Misc. | Balance | Balance | Balance | Balance | Balance |

[1]Linear alkylbenzene sulfonate.
[2]Alkyl sulfate.
[3]Coco-dihydroxyethylmethyl ammonium salt.
[4]Polycarboxylate or copolymer of acrylic acid and maleic acid.
[5]3,3'-Thio-di-propionic acid.
[6]Nonanoyl benzene sulfonate.
[7]Stabilized percarbonate.
[8]Metalose-methyl cellulose.
[9]Polyethylene glycol MW4000.

What is claimed is:

1. A fabric care composition comprising:

a) from 0.01% by weight, of a bleach scavenging system, said system comprising at least one compound from (i) or (ii):

i) one or more organic sulfur compounds having the formula:

R—S—R or R—S—S—R wherein each R is independently hydrogen, $C_2$–$C_{20}$ linear or branched, substituted or unsubstituted alkyl; provided at least one R unit is not hydrogen; or ii) one or more inorganic sulfur compounds selected from the group consisting of the sodium, potassium, lithium, calcium, and magnesium salts of metabisulfite, thiosulfite , sulfite, bisulfate, and mixtures thereof;

b) a dye fixative; and c) the balance carrier and adjunct ingredients.

2. A fabric care composition according to claim 1 wherein the compound from (i) or (ii) is 3,3-thiodipropionic acid.

3. A fabric care composition according to claim 2 wherein the composition further comprises a polyamine chelant.

4. A fabric care composition according to claim 1 wherein the composition further comprises from about 0.001% to about 90% by weight, of one or more crystal growth inhibitors.

5. A fabric care composition according to claim 1 wherein the composition further comprises from about 0.01% to about 20% by weight, of a fabric abrasion reducing polymer.

6. A fabric care composition according to claim 1 wherein the composition further comprises from about 1% to about 12% by weight, of one or more liquid carriers.

7. A fabric care composition according to claim 1 wherein the composition further comprises from about 0.001% to about 1% by weight, of an enzyme.

8. A fabric care composition according to claim 1 wherein the composition further comprises from about 0.01% to about 8% by weight, of a polyolefin emulsion or suspension.

9. A fabric care composition according to claim 1 wherein the composition further comprises from about 0.01% to about 0.2% by weight, of a stabilizer.

10. A fabric care composition according to claim 1 wherein the composition further comprises from about 1% to about 80% by weight, of a fabric softening active.

11. A fabric care composition according to claim 1 wherein the composition further comprises less than about 15% by weight, of a principal solvent.

12. A fabric care composition according to claim 1 wherein the composition further comprises from about 0.5% to about 10% by weight, of a cationic nitrogen compound.

13. A fabric care composition according to claim 1 wherein the composition further comprises a chelant.

14. A method for preventing loss of fabric color due to sunlight, said method comprising the stop of contacting fabric which will be exposed to sunlight with a composition according to claim 1.

15. A method for preventing loss of fabric color due to sunlight, said method comprising the step of contacting fabric which will be exposed to sunlight with a composition according to claim 3.

16. A fabric care composition comprising:

a) from 0.01% by weight, of a bleach scavenging system, said system comprising at least one compound from (i) or (ii):

i) one or more organic sulfur compounds having the formula:

R—S—R or R—S—S— wherein each R is independently hydrogen, $C_2$–$C_{20}$ linear or branched, substituted or unsubstituted alkyl; provided at least one R unit is not hydrogen; or ii) one or more inorganic sulfur compounds selected from the group consisting of the sodium, potassium, lithium, calcium, and magnesium salts of metabisulfite, thiosulfate, sulfite, bisulfite, and mixtures thereof;

a) a dye fixative;

b) a chelant; and c) a carrier.

17. A fabric care composition according to claim 16 wherein the compound from (i) or (ii) is 3,3-thiodipropionic acid.

18. A fabric care composition according to claim 16 wherein the composition further comprises from about 0.01% to about 20% by weight, of a fabric abrasion reducing polymer.

19. A fabric care composition according to claim 16 wherein the chelant is a polyamine chelant.

20. A fabric care composition according to claim 19 wherein the composition further comprises from about 0.01% to about 20% by weight, of a fabric abrasion reducing polymer.

* * * * *